US010556143B2

(12) United States Patent
Sherin

(10) Patent No.: US 10,556,143 B2
(45) Date of Patent: Feb. 11, 2020

(54) CONSTANT FORCE RESISTANCE CABLE RETRACTOR

(71) Applicant: Keph Sherin, Portland, OR (US)

(72) Inventor: Keph Sherin, Portland, OR (US)

(73) Assignee: Keph Sherin, Portland, OR (US)

( * ) Notice: Subject to any disclaimer, the term of this patent is extended or adjusted under 35 U.S.C. 154(b) by 36 days.

(21) Appl. No.: 15/881,603

(22) Filed: Jan. 26, 2018

(65) Prior Publication Data

US 2018/0214731 A1 Aug. 2, 2018

Related U.S. Application Data

(60) Provisional application No. 62/451,602, filed on Jan. 27, 2017.

(51) Int. Cl.
*A63B 21/02* (2006.01)

(52) U.S. Cl.
CPC ..... *A63B 21/023* (2013.01)

(58) Field of Classification Search
CPC ..... A63B 21/02; A63B 21/0006; A63B 21/15; A63B 2071/0072; A63B 2071/065
See application file for complete search history.

(56) References Cited

U.S. PATENT DOCUMENTS 4,135,714 A * 1/1979 Hughes ..... A63B 21/04 473/229
4,328,965 A * 5/1982 Hatfield ..... A63B 21/025 124/23.1
4,456,247 A 6/1984 Ehrenfried
4,685,670 A * 8/1987 Zinkin ..... A63B 21/04 482/129
4,779,866 A * 10/1988 Marshall ..... A63B 21/015 482/116
4,961,573 A * 10/1990 Wehrell ..... A63B 21/0552 482/124
4,979,733 A * 12/1990 Prud'Hon ..... A63B 21/0058 482/4
5,090,694 A * 2/1992 Pauls ..... A63B 21/015 482/118

(Continued)

OTHER PUBLICATIONS

International Search Report and Written Opinion received for International Application No. PCT/US2018/015571, dated Apr. 13, 2018, 10 pages.

(Continued)

*Primary Examiner* — Garrett K Atkinson
(74) *Attorney, Agent, or Firm* — Morrison and Foerster LLP

(57) ABSTRACT

A device and method for exercising that includes a main axle, a cord spool attached to the main axle, a cord wrapped around the cord spool, resistance modules, and a resistance selector. The drum of each resistance module attaches to the main axle. The drum of each resistance module is attached to a spring configured to resist the cord being pulled from the cord spool. The drums of the resistance modules are configured with engagement patterns that allow for the drums of adjacent resistance modules to couple together. The resistance selector determines how many resistance modules are coupled together. The resistance level of the device can be adjusted to the desired resistance level by coupling together the desired number of resistance modules.

20 Claims, 35 Drawing Sheets

(56) References Cited

U.S. PATENT DOCUMENTS 5,147,265 A * 9/1992 Pauls ..... A63B 21/015 482/115
5,226,867 A * 7/1993 Beal ..... A63B 21/153 482/120
5,382,212 A * 1/1995 Davenport ..... A63B 21/04 482/121
5,486,149 A * 1/1996 Smith ..... A63B 21/015 482/120
5,505,681 A 4/1996 Bruggemann
5,586,962 A * 12/1996 Hallmark ..... A63B 21/04 482/123
5,618,249 A * 4/1997 Marshall ..... A63B 21/153 482/115
5,733,231 A * 3/1998 Corn ..... A63B 21/025 482/120
6,120,423 A 9/2000 Mackey et al.
6,436,006 B1 * 8/2002 Zemlyakov ..... A63B 21/0083 482/112
6,440,044 B1 * 8/2002 Francis ..... A63B 21/0455 482/114
6,685,602 B2 * 2/2004 Colosky, Jr. ..... A63B 21/025 482/122
6,733,428 B2 5/2004 List
6,790,166 B2 9/2004 Broudy
6,837,838 B2 1/2005 List
6,929,589 B1 * 8/2005 Bruggemann ..... A63B 21/025 482/121
7,229,391 B2 6/2007 Francis
7,462,141 B1 * 12/2008 Raboin ..... A63B 21/225 482/110
7,468,019 B2 12/2008 Zylstra
7,871,359 B2 * 1/2011 Humble ..... A63B 21/153 242/375.1
7,878,955 B1 * 2/2011 Ehrlich ..... A63B 21/025 482/127
8,002,677 B2 * 8/2011 Dibble ..... A63B 21/045 482/127
8,348,816 B2 1/2013 Gerschefske et al.
8,715,146 B2 5/2014 Bronston et al.
9,199,123 B2 12/2015 Solow et al.
9,320,936 B1 * 4/2016 Rea ..... A63B 21/4009
9,370,679 B2 6/2016 Lagree et al.
9,700,314 B2 7/2017 Marczyk
2002/0025891 A1 * 2/2002 Colosky, Jr. ..... A63B 21/025 482/127
2004/0102294 A1 5/2004 Chen
2005/0181915 A1 * 8/2005 Hoecht ..... A63B 21/023 482/127
2006/0063650 A1 3/2006 Francis
2008/0085820 A1 4/2008 Majkrzak
2010/0016131 A1 1/2010 Hoffman
2010/0130338 A1 * 5/2010 Wehrell ..... A61H 1/0229 482/124
2010/0204024 A1 8/2010 Mills et al.
2010/0267533 A1 10/2010 Susnjara
2015/0111705 A1 4/2015 Walker et al.

OTHER PUBLICATIONS

International Search Report and Written Opinion received for International Application No. PCT/US2017/048703, dated Nov. 6, 2017, 9 pages.

* cited by examiner

CONSTANT FORCE RESISTANCE CABLE RETRACTOR

CROSS-REFERENCE TO RELATED APPLICATIONS

This application claims priority to U.S. Provisional Patent Application No. 62/451,602, entitled "CONSTANT FORCE RESISTANCE CABLE RETRACTOR", filed on Jan. 27, 2017, the content of which is hereby incorporated by reference in its entirety.

FIELD OF THE INVENTION

The present disclosure relates generally to the field of exercise equipment, and more specifically to a cable retractor device that provides constant force resistance at each resistance level of a plurality of adjustable resistance levels, wherein the resistance level can be easily adjusted by a user.

BACKGROUND OF THE INVENTION

A cable retractor device can be used in a variety of exercises. One such type of exercise is Pilates. In particular, existing cable retracting devices facilitate exercises, such as Pilates, that are not possible or practical with either body weight or free weights. Specifically, some Pilates exercises are accomplished while free standing and without any additional equipment, simply incorporating only the body weight of the user. However, body weight exercises are not always possible or practical, for body weight may not represent the appropriate amount of resistance, and the gravitational force may not be in the appropriate direction for the exercise. Some Pilates exercises are accomplished with the use of free weights. Yet, while the amount of resistive force can be better controlled using free weights, the force is still restricted to a single direction because the exercise relies on the force of gravity.

As such, to address these types of problems, some existing cable retractor devices provide resistance through an elastic band or a traditional spring. Elastic bands and traditional springs provide variable resistance such that as the range of motion of the exercise increases, the resistance provided by the elastic band or spring increases. However, variable resistance can be problematic in exercise devices because muscle strength varies depending on how far the muscle is extended. For example, most muscles are at their weakest state when fully extended. As a result, exercise devices employing variable resistance are often at their maximum resistance level when the muscle of the user is at its weakest, which results in a less efficient exercise for the user.

Another difficulty in designing cable retractor devices that facilitate exercises is that users differ in size and strength, and thus require differing levels of resistance to train optimally. Moreover, the resistance level required for an individual user can vary over time as the user progresses or regresses based on his or her training habits, muscle development, injury, etc. Some cable retractor devices have a single non-adjustable resistance level; others allow the resistance level to be adjusted but only in a cumbersome manner.

Thus, there is a need for a cable retractor device that can be used, as both a standalone device or as a component of larger exercise equipment, to provide a constant force resistance at each available resistance level, where the resistance level can easily be adjusted to accommodate for the diverse physical characteristics of different users.

BRIEF SUMMARY OF THE INVENTION

The present disclosure solves the aforementioned problems of previous devices by providing a cable retractor device that provides constant force resistance at each resistance level amongst a plurality of adjustable resistance levels provided by the device and a method of use thereof. In particular, the resistance level can be easily adjusted by the user as needed.

In accordance with some embodiments, an apparatus for providing a substantially constant level of resistance is described. The apparatus comprises a first resistance module configured to provide a substantially constant force resistance at a first resistance level. The first resistance module includes a first coupling component, a first drum, and a first constant-force spring having the first resistance level, and a first end of the first constant-force spring is connected to the first drum. The apparatus also comprises a second resistance module configured to provide a substantially constant force resistance at a second resistance level. The second resistance module includes a second drum and a second constant-force spring having the second resistance level, and a first end of the second constant-force spring is connected to the second drum. Further, the second resistance module is coupled to the first resistance module via the first coupling component, the coupled first and second resistance modules are configured to provide a substantially constant combined force resistance, and the combined force resistance is the sum of the first resistance level and the second resistance level.

In accordance with some embodiments, a method for using the apparatus to provide a substantially constant level of resistance is described. The apparatus has a first resistance module having a first constant-force spring and a second resistance module having a second constant-force spring. The method comprises providing, when the apparatus is oriented at a first angle from the ground, a first substantially constant resistance level, and providing, when the apparatus is oriented at a second angle from the ground, the first substantially constant resistance level, where the second angle is different from the first angle. The method also comprises coupling the first resistance module with the second resistance module. The method further comprises providing, when the apparatus is oriented at the first angle from the ground, a second substantially constant resistance level, and providing, when the apparatus is oriented at the second angle from the ground, the second substantially constant resistance level.

Other objects and features of the present disclosure will become apparent by a review of the specification, claims, and appended figures.

BRIEF DESCRIPTION OF THE DRAWINGS

For a better understanding of the various described embodiments, reference should be made to the Detailed Description of the Invention below, in conjunction with the following drawings in which like reference numerals refer to corresponding parts throughout the figures.

DETAILED DESCRIPTION OF THE INVENTION

The following description sets forth exemplary methods, parameters, and the like. It should be recognized, however, that such description is not intended as a limitation on the scope of the present disclosure but is instead provided as a description of exemplary embodiments.

The present disclosure is directed to a cable retractor device and methods of using the device. Importantly, the described cable retractor device can be used either as a standalone exercise device or as a component of a larger exercise equipment (e.g., as a part of a Pilates fitness system). For example, the cable retractor device may be used as a standalone device when attached to a wall or any form of sliding system, rotating cam, or any other possible mounting system. The cable retractor can then be used for any number of Pilates or non-Pilates related exercises. Further, the cable retractor device may be used along with one or more additional cable retractor devices.

The device includes a housing that encloses a set of resistance modules and a cord wrapped around a cord spool.

The cord can pass through the housing when it is pulled off of the cord spool. Each resistance module contains a constant force spring that is configured to resist the cord being pulled off of the cord spool during an exercise. The constant force spring of the resistance module can be selected to provide the desired level of resistance (e.g. 1, 2, 3, 4 lbs.) provided by each resistance module. The constant force springs can all be rated for the same load or can be rated for different loads. Furthermore, the device can be made to have any number of resistance modules. Additionally, each resistance module has engagement patterns that allow an adjacent resistance module to be coupled together to adjust the overall level of resistance—the overall resistance level of the device increases as an increasing number of resistance modules are coupled together because the constant force spring in each of the coupled resistance modules resists the rotation of the cord spool as the cord is pulled off of the cord spool.

In one exemplary embodiment, the device includes a resistance selector configured to adjust the coupling between adjacent resistance modules and thereby adjust the resistance level of the device. In another exemplary embodiment, each resistance module includes a switch configured to adjust the coupling of resistance modules. In another exemplary embodiment, each resistance module is configured to be removable from the device.

Figure 1:
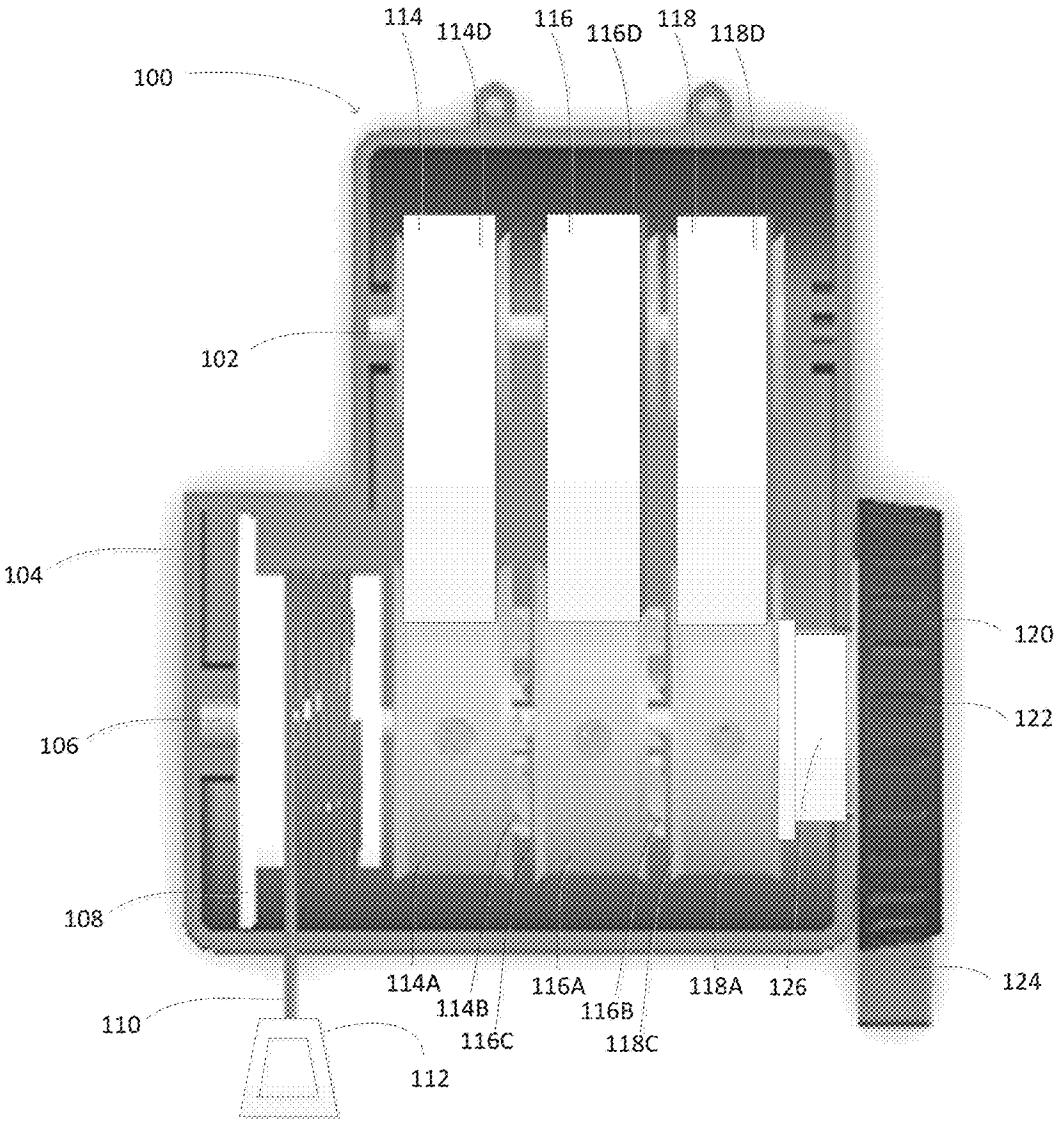
FIG. 1 illustrates a perspective view of one embodiment of the cable retractor device where the resistance level can be adjusted through a resistance selector.

FIG. 1 is a perspective view of one embodiment of a device 100. The device 100 includes a housing 104. The housing 104 encloses a cord spool 108, cord 110, axles 102 and 106, and resistance modules 114, 116, and 118. In some embodiments, the housing 104 has a cross section that is rectangular. In other embodiments the housing 104 may be any other shape including free form. The housing 104 may be any size sufficient to enclose the necessary components and to provide the necessary structural strength for the device 100.

The cord 110 wraps around the cord spool 108. In some embodiments, the cord 110 is made out of rope. In other embodiments, the cord 110 is made out of any number of materials including plastic, rubber, or any combination of those or other materials. In some embodiments, the cord spool is outside of the housing that encloses the resistance modules (e.g. the cord spool 108 is in separate housing that is attached to the housing 104 enclosing the resistance modules 114, 116, 118).

In some embodiments, the device 100 includes a handle 112 that connects to the cord 110. The cord 110 passes through an opening in the housing 104 when the cord is retracted onto or pulled off of the cord spool 108 using the handle 112. That is, the handle 112 allows the user to pull the cord 110 off of the cord spool 108 when force is applied by pulling the handle 112. When force is removed from the handle 112, the cord 110 is retracted back onto the cord spool 108. The handle 112 can be made out of one or more of any number of materials or finishes, including wood, plastic, metal, rubber, or any combination of these or other materials. In some embodiments, other accessories can be attached to the cord 110.

Figure 2:
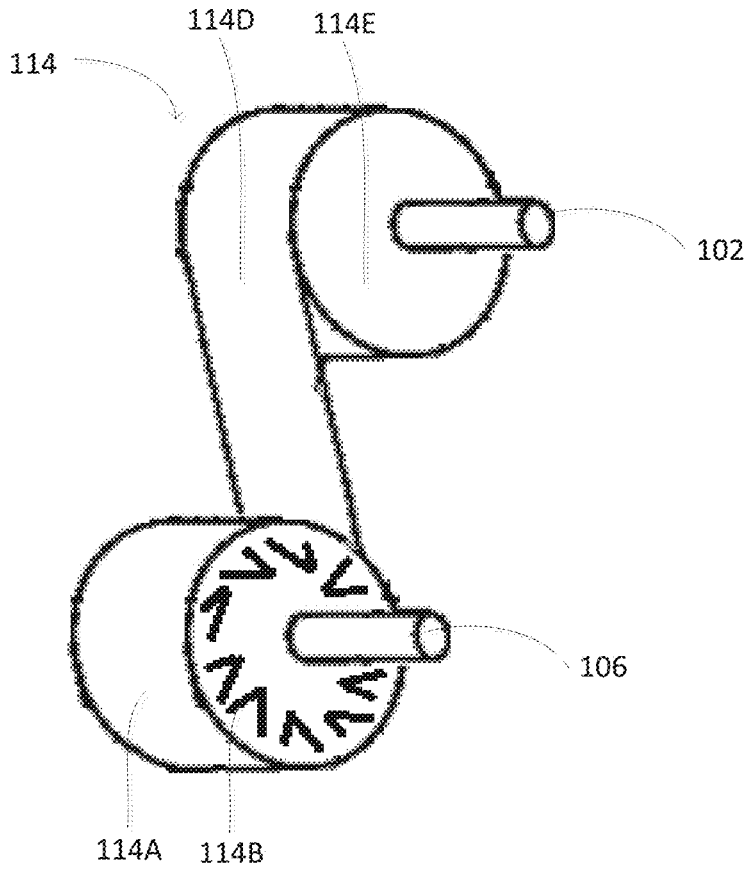
FIG. 2 illustrates a perspective view of an exemplary resistance module.

FIG. 2 is a perspective view of an exemplary resistance module 114. The housing 104 contains two or more resistance modules (e.g., 114, 116, 118). In an exemplary embodiment, the resistance module 114 includes a constant force spring 114D, a first storage drum 114E, and a second storage drum 114A, and the constant force spring 114D is affixed to the first storage drum 114E and second storage drum 114A via a screw, adhesive, or any combination of those or other materials. In another exemplary embodiment, the constant force spring is configured to wrap around the first storage drum 114E and the second storage drum 114A without being affixed to the first storage drum 114E and the second storage drum 114A.

Constant force springs are a commercially available type of spring that provide nearly a constant load throughout the spring range of motion. For example, for one commercially available spring the load provided by the spring ramps up from no load to its rated load over the initial 2-3 turns of the spring around the drum that stores the spring. After those initial 2-3 turns the constant force spring provides roughly a constant load as the spring is moved throughout the spring's range of motion. The spring can provide a load that is within 10% of the rated load of the constant force spring after the 2-3 turns of the spring. Constant force springs can provide a nearly identical load regardless of the orientation of the constant force spring. For example, a constant force spring provides a load when pulled parallel to the ground that is nearly identical as when pulled perpendicular to the ground.

In some embodiments, the constant force spring 114D is configured to be in an S-shape arrangement. In the S-shape arrangement, the constant force spring wraps around the first storage drum 114E in one direction (e.g. a clock-wise direction) and wraps around the second storage drum 114A in the opposite direction (e.g. a counter clock-wise direction). The axle 102 is configured to pass through the first storage drum 114E and the axle 106 passes through the second storage drum 114A.

Figure 7:
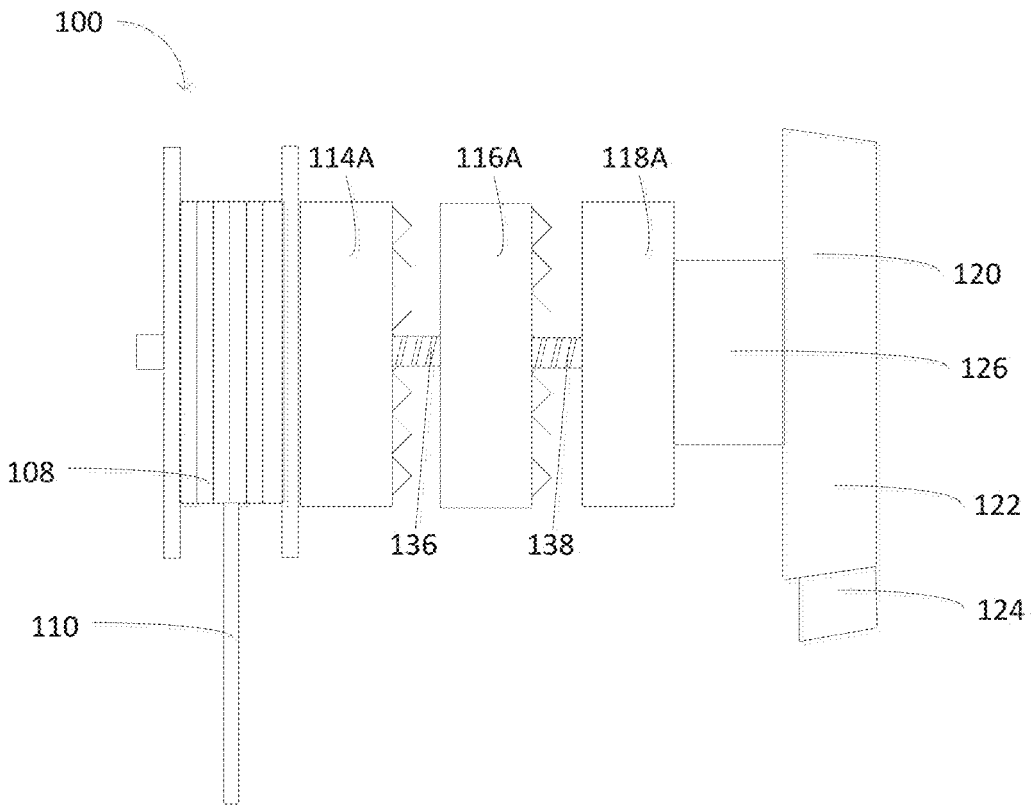
FIG. 7 illustrates compression springs separating the drums of exemplary resistance modules.

In some embodiments, as illustrated in FIG. 7, the device 100 includes a first compression spring 136 located between the second storage drum 114A and the second storage drum 116A and a second compression spring 138 located between the second storage drum 116A and the second storage drum 118A. In some embodiments, the first and second compression springs are configured to have different load resistances, thus allowing the resistance modules to be selectively coupled in order to adjust the resistance level, as described in greater detail below. In some embodiments, the load resistance of second compression spring is greater than the load resistance of the first compression spring 136. In some embodiments, a compression spring separates the cable spool 108 from the second storage drum 114A.

Figure 3:
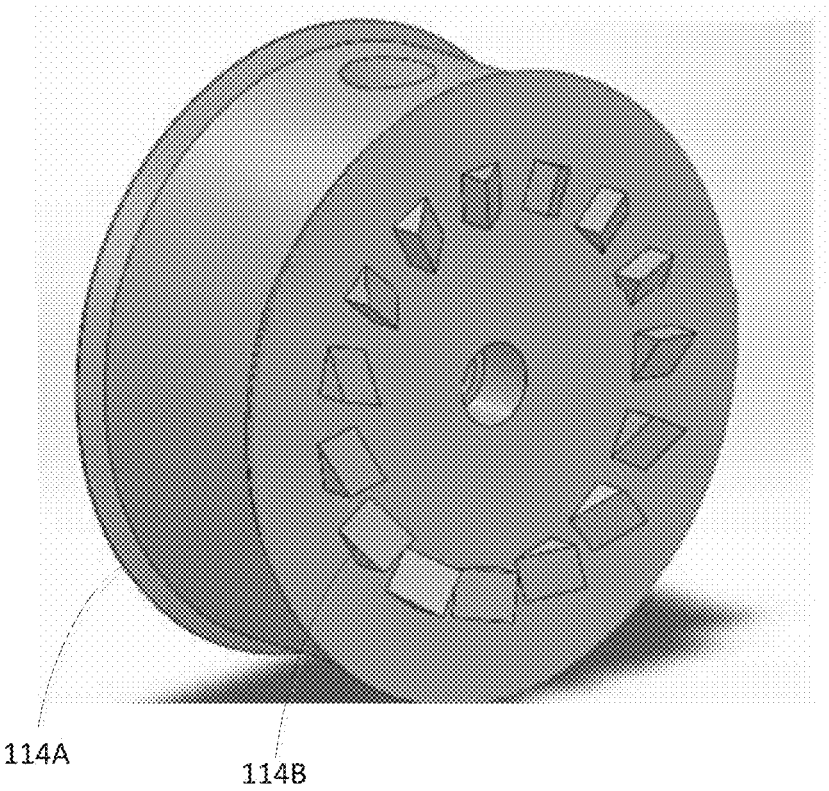
FIG. 3 illustrates a drum of an exemplary resistance module having a teeth coupling component.
Figure 4:
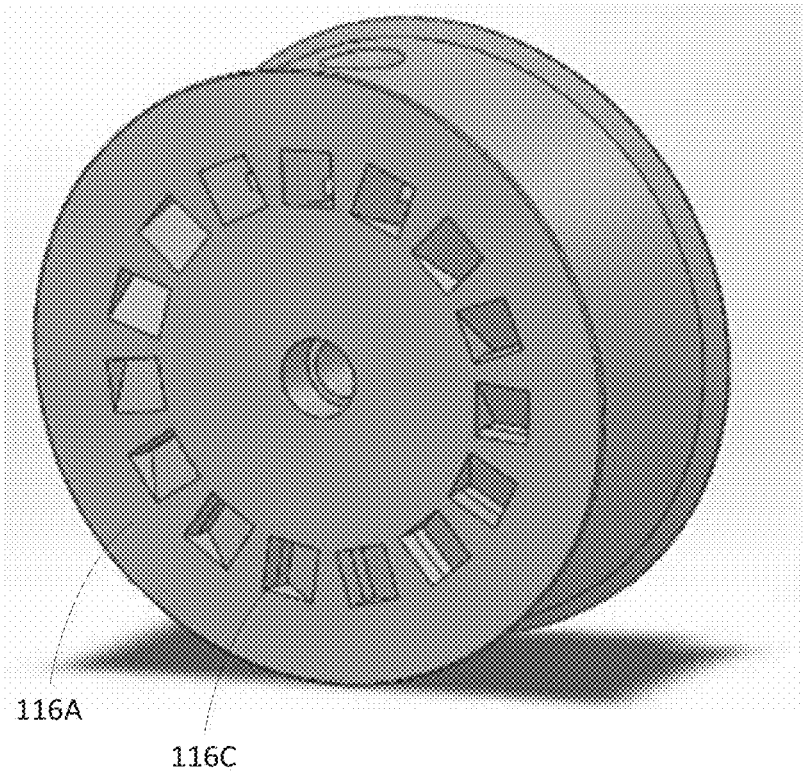
FIG. 4 illustrates a drum of an exemplary resistance module having a teeth coupling component and corresponding receptive holes.

In some embodiments, the second storage drum 114A includes an engagement pattern. In some embodiments, the engagement pattern is a set of teeth 114B. As shown in FIGS. 1, 3, and 4, the teeth 114B are configured to match the holes 116C of the adjacent second storage drum 116A. The engagement patterns are configured to couple two adjacent drums together.

In other embodiments, the second storage drum 114A does not include holes and is instead affixed to the cord spool 108 such that the second storage drum 114A is caused to be rotated by the cord spool 108 when the cord spool 108 rotates. Thus, the constant force spring 114D resists the movement of the cord 110 off of the cord spool 108, and, as such, the device 100 provides resistance.

In some embodiments, the second storage drum 116A includes an engagement pattern on both sides of the drum. As described above, the engagement pattern on one side of the drum may be a set of teeth 116B and the engagement pattern on the other side of the drum may be holes 116C. As shown in FIGS. 1, 3, and 4, the teeth 116B are configured to match the holes 118C on the adjacent second storage drum 118A. Thus, the engagement patterns are configured to couple adjacent drums together.

In some embodiments, the second storage drum 118A has an engagement pattern on one side. As described above, the engagement pattern may be a set of holes 118C. In some embodiments, the second storage drum 118A is affixed to the pusher 126 such that second storage drum 118A is configured to move along the shaft 106 in the same direction as the pusher 126. As a result, the pusher 126 causes the coupling of resistance modules 114, 116, and 118 together.

For example, the shaft 106 is configured to pass through the cord spool 108, the second storage drums 114A, 116A, and 118A, and the pusher 126. A shaft 102 is configured to pass through the first storage drums of resistance modules 114, 116, and 118. The constant force springs 114D, 116D, and 118D are configured to resist the rotation of second storage drums 114A, 116A, and 118A. Constant force springs provide a constant level of resistance across the entire range that the second storage drums 114A, 116A, and 118A are rotated. Thus, the constant force springs provide the device 100 with the ability to provide a constant resistance level as the handle 112 pulls the cord 110 off of the cord spool 108.

However, the constant force springs 114D, 116D, and 118D only resist movement of the cord 110 off of the cord spool 108 when the associated second storage drums 114A, 116A, and 118A are attached to the cord spool 108 or coupled with another second storage drum (e.g., when the second storage drum 114A is attached to the cord spool 108). As a result, the constant force spring 114D is caused to resist the movement of the cord 110 off of the cord spool 108. However, the constant force spring 116D only resists the movement of the cord 110 off of the cord spool 108 when the second storage drum 116A is coupled to second storage drum 114A. Similarly, the constant force spring 118D is caused to resist the movement of the cord 110 off of the cord spool 108 only when the second storage drum 118A is coupled to the second storage drum 116D. Thus, by selectively coupling the second storage drums 116A and 118A to other second storage drums, the overall resistance level of the device 100 can be adjusted.

Figure 5:
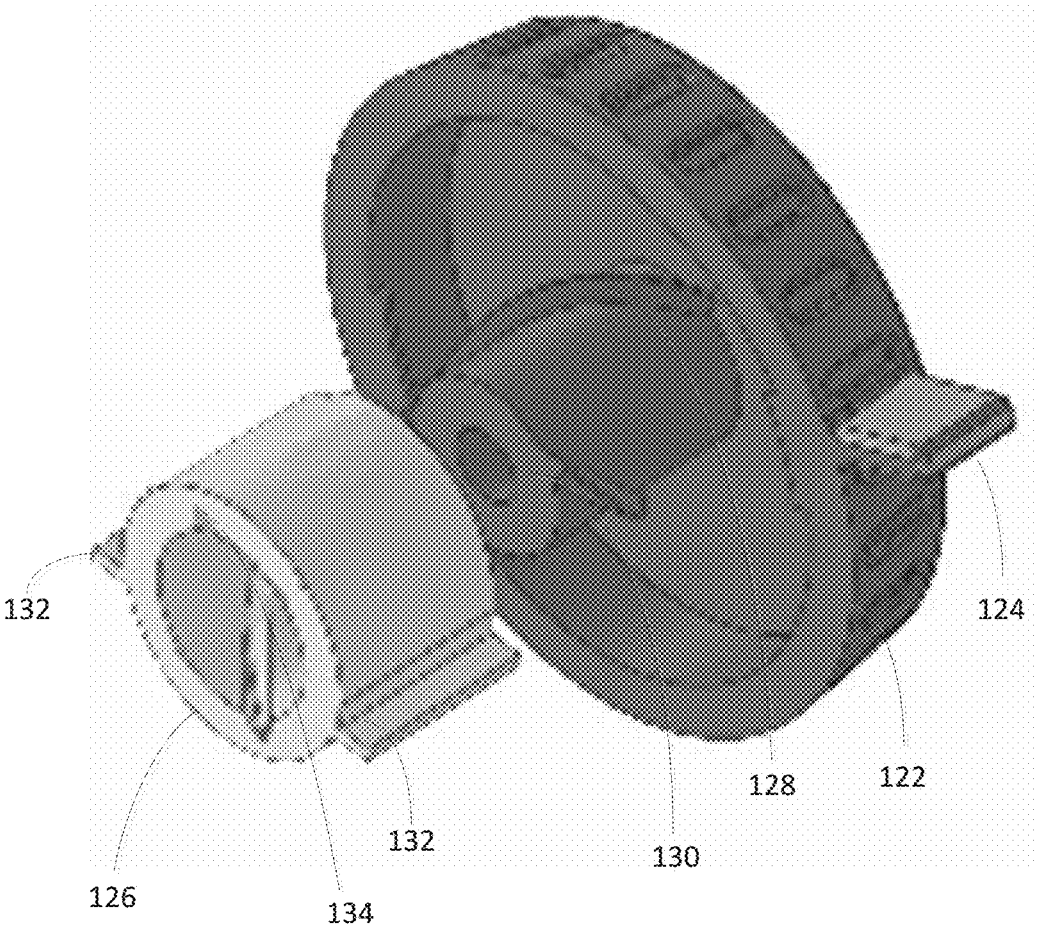
FIG. 5 illustrates an exemplary resistance selector.
Figure 6:
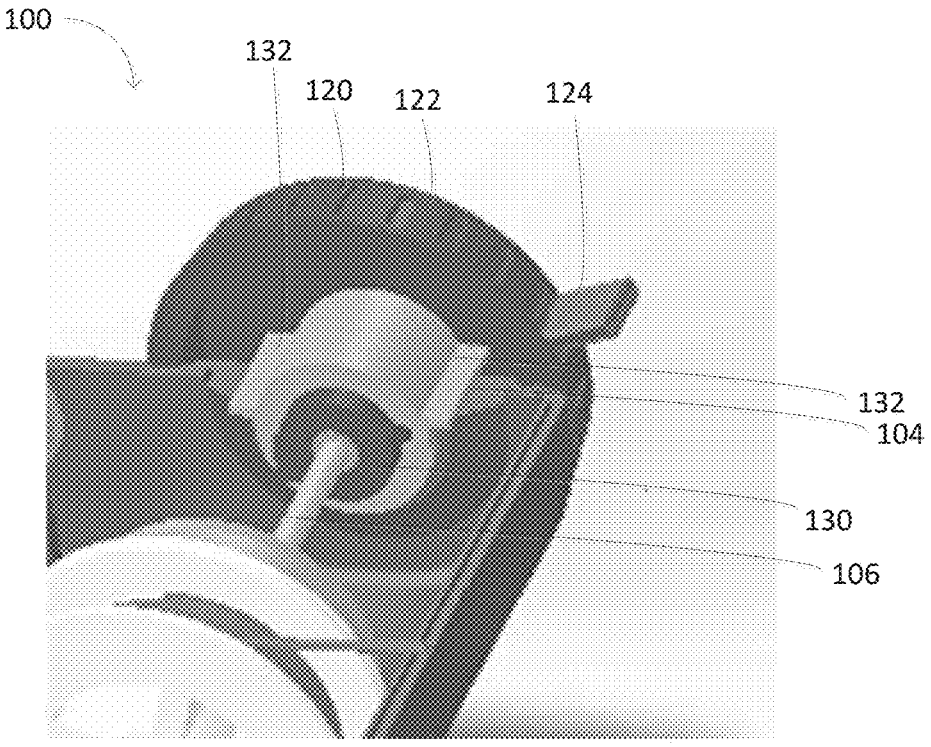
FIG. 6 illustrates an exemplary resistance selector.

In some embodiments, the device 100 includes a resistance selector 120 that is configured to adjust the resistance level of the device 100. In one embodiment, the resistance selector 120 is comprised of an adjustment knob 122 and a pusher 126. In one embodiment, as illustrated in FIG. 5, the adjustment knob 122 includes a threaded shaft 130, a thread 128 wraps around the threaded shaft 130, and the threaded shaft 130 passes inside the pusher 126. Further, the thread 128 is positioned inside a thread notch 134 of the pusher 126. As shown in FIG. 5, the pusher 126 includes flaps 132 on two sides, which are configured to contact the housing 104. The flaps 132 are configured to prevent rotation of the pusher 126 around the shaft 106 when the resistance selector 120 is rotated. Instead, the flaps 132 are configured to force the pusher 126 to move along the shaft 106 in a direction determined by the direction that the resistance selector 120 is rotated.

In some embodiments, when the resistance level is adjusted, the device 100 indicates to the user that a new resistance level has been set. For example, the adjustment knob 122 includes a resistance indicator 124 that displays a visual indication of the current overall resistance level. The indication of the overall resistance level can be tactile, audible, and/or visual.

The following describes the device 100 providing constant force resistance at each resistance level amongst a plurality of adjustable resistance levels.

A resistance selector 120 is moved to a first constant resistance level. Rotating the adjustment knob 122 causes the threaded shaft 130 to rotate. The threaded shaft 130 rotating causes the thread 128 to rotate. The thread 128 rotating causes force to be applied to the pusher 126 via the threaded notch 134. The flaps 132 prevent the pusher from rotating around the shaft 106; instead the pusher 126 is forced to move along the shaft 106. The force applied to the pusher 126 causes the pusher 126 to move up or down the shaft 106 in a direction that depends on the direction that the adjustment knob is rotated.

For the sake of discussion, assume that none of the second storage drums 114A, 116A, and 118A are coupled together. In this configuration, only the constant force spring 114D resists the movement of cord 110 off of the cord spool 108 because the second storage drum 114A is attached to the cord spool 108. This represents the lowest resistance level for which the device 100 can be configured.

Rotating the adjustment knob 122 of the resistance selector 120 in the direction that increases the resistance level results in the pusher 126 moving on the shaft 106 towards the second storage drum 116A. Since the pusher 126 is attached to the second storage drum 118A, the movement of the pusher 126 causes the second storage drum 118A to compress the compression spring 138. The compression spring 138 resists the movement of the second storage drum 118A along the shaft 106 and causes the second storage drum 116A to move toward the second storage drum 114A. As described above, the load resistance of the compression spring 136 is less than the load resistance of the compression spring 138. Because of this, as the adjustment knob 122 is rotated, the second storage drums 114A and 116A couple together before second storage drums 116A and 118A. This engagement causes the teeth 114B of second storage drum 114 to couple with the holes 116C of the second storage drum 116A. When the teeth 114B and holes 116C are coupled in this manner, both constant force springs 114D and 116D resist the cord 110 from being pulled off the cord spool 108 resulting in increased resistance. This configuration represents the second lowest resistance level for which the device 100 can be configured.

The user pulls the cord 110 off of the cord spool 108. In this configuration, both constant force springs 114D and 116D resist the movement of the cord 110 off of cord spool 108. This is because second storage drum 114A is directly attached to cord spool 108 and because second storage drum 116A is coupled with second storage drum 114A. Constant force springs 114D and 116D are configured to resist the movement of the cord 110 off of cord spool 108.

The user stops pulling the cord 110, which causes the cord 110 to retract onto the cord spool 108. The cord retracts due to the force produced by constant force springs 114D and 116D on second storage drums 114A and 116A.

The user rotates the resistance selector 120 to a second constant resistance level. Rotating the adjustment knob 122 in the direction that increases the resistance level results in the pusher 126 again moving on the shaft 106 towards the second storage drum 116A. The compression spring 138 again resists the movement of the second storage drum 118A. However, when the adjustment knob 122 is rotated far enough, the second storage drums 116A and 118A couple together. This coupling is caused by the teeth 116B of second storage drum 116A coupling with the holes 118C of second storage drum 118A. When the teeth 116B and holes 118C are coupled, the constant force springs 114D, 116D, and 118D all resist the cord 110 being pulled off the cord spool 108. This configuration represents the highest resistance level of the device 100 since the constant force springs in resistance modules 114, 116, and 118 resist the cord 110 being pulled off the cord spool 108.

The user pulls the cord 110 off of the cord spool 108. In this configuration, the constant force springs 114D, 116D, and 118D resist the movement of the cord 110 off of cord spool 108. This is because second storage drum 114A is directly attached to cord spool 108 and because second storage drum 116A and 118A are coupled with second storage drum 114A. Constant force springs 114D, 116D, and 118D are configured to resist the movement of the cord 110 off of cord spool 108.

The user stops pulling the cord 110, which causes the cord 110 to retract onto the cord spool 108. The cord retracts due to the force produced by constant force springs 114D, 116D, and 118D on second storage drums 114A, 116A, and 118A.

Rotating the adjustment knob 122 in the direction that decreases the resistance level results in the pusher 126 moving on the shaft 106 away from the second storage drum 116A. Since the pusher 126 is attached to the second storage drum 118A the movement of the pusher causes the second storage drum 118A to apply less force to the compression spring 138 and the second storage drum 116A. When the adjustment knob 122 is rotated far enough, the teeth 116B of second storage drum 116A decouple with the holes 118C of the second storage drum 118A. When the teeth 116B and teeth holes 118C are decoupled, only the constant force springs 114D and 116D resist the cord 110 from being pulled off the cord spool 108. Continuing to adjust the adjustment knob 122 in the same direction further decreases the resistance level as the teeth 114B and holes 116C of second storage drums 114A and 116A decouple.

Figure 8:
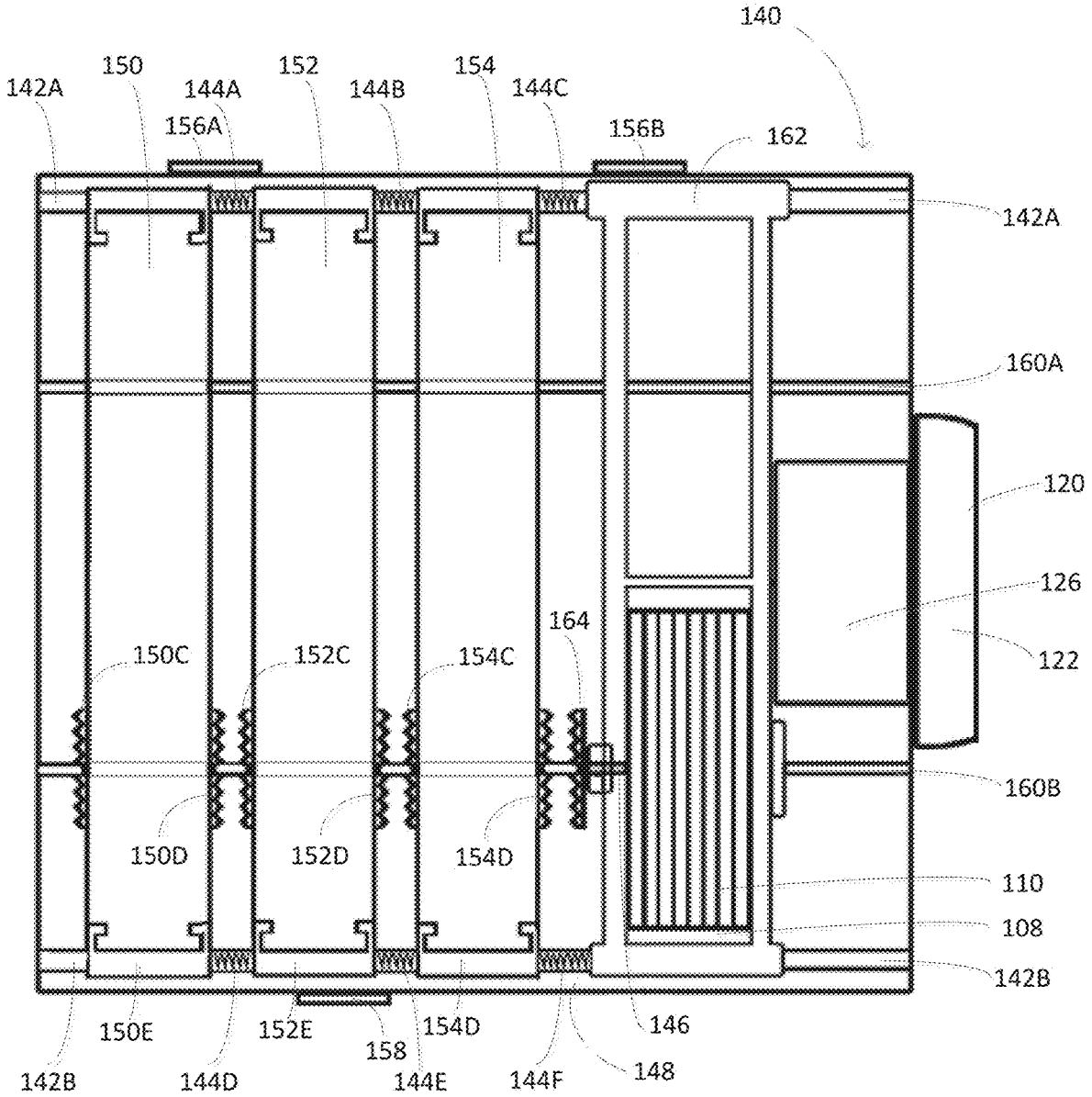
FIG. 8 illustrates another exemplary embodiment of the cable retractor device that provides for removable resistance modules.

FIG. 8 is a perspective view of another exemplary embodiment of the device. The device 140 includes a housing 148. The housing 148 encloses one or more removable resistance modules (e.g., 150, 152, 154). As described below with reference to FIG. 9, a resistance module is configured to be easily removed from and inserted into the device 140. The housing 148 also encloses a cord spool cartridge 162.

Figure 9:
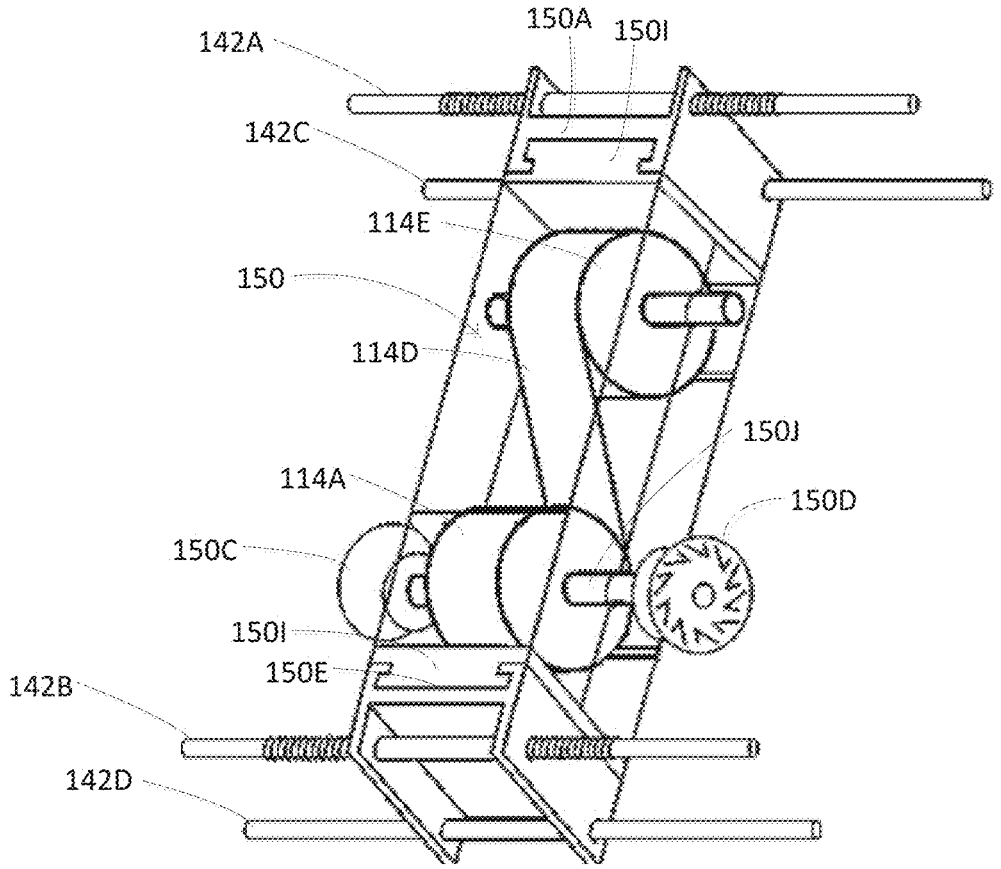
FIG. 9 illustrates an exemplary removable resistance module.

FIG. 9 is a perspective view of the removable resistance module 150. The removable resistance module 150 includes a module housing 1501. The module housing 1501 encloses a constant force spring 114D, a first storage drum 114E, and a second storage drum 114A. A shaft 150J runs through the second storage drum 114D. The ends of the shaft 150J are configured with interlocking gears 150C and interlocking gears 150D. The gears are configured to form an engagement pattern such that the interlocking gears from one resistance module can couple with the interlocking gears of an adjacent resistance module. When the interlocking gears of adjacent resistance modules are coupled, the constant force spring of all of the coupled resistance modules resist the movement of the cord 110 off of the cord spool 108.

In one embodiment, the rods 142A, 142B, 142C, and 142D pass through the module holders 150A and 150E and support the module holders 150A and 150E. The device 100 could also support the module holders 150A and 150E with a different number of rods. The resistance module housing 1501 is configured to fit into the module holders 150A and 150E and be removable from the module holders 150A and 150E. The module holders 150A and 150E as well as the removable resistance module 150 are configured to move, in either direction, on the rods 142A, 142B, 142C, and 142D.

Figure 14:
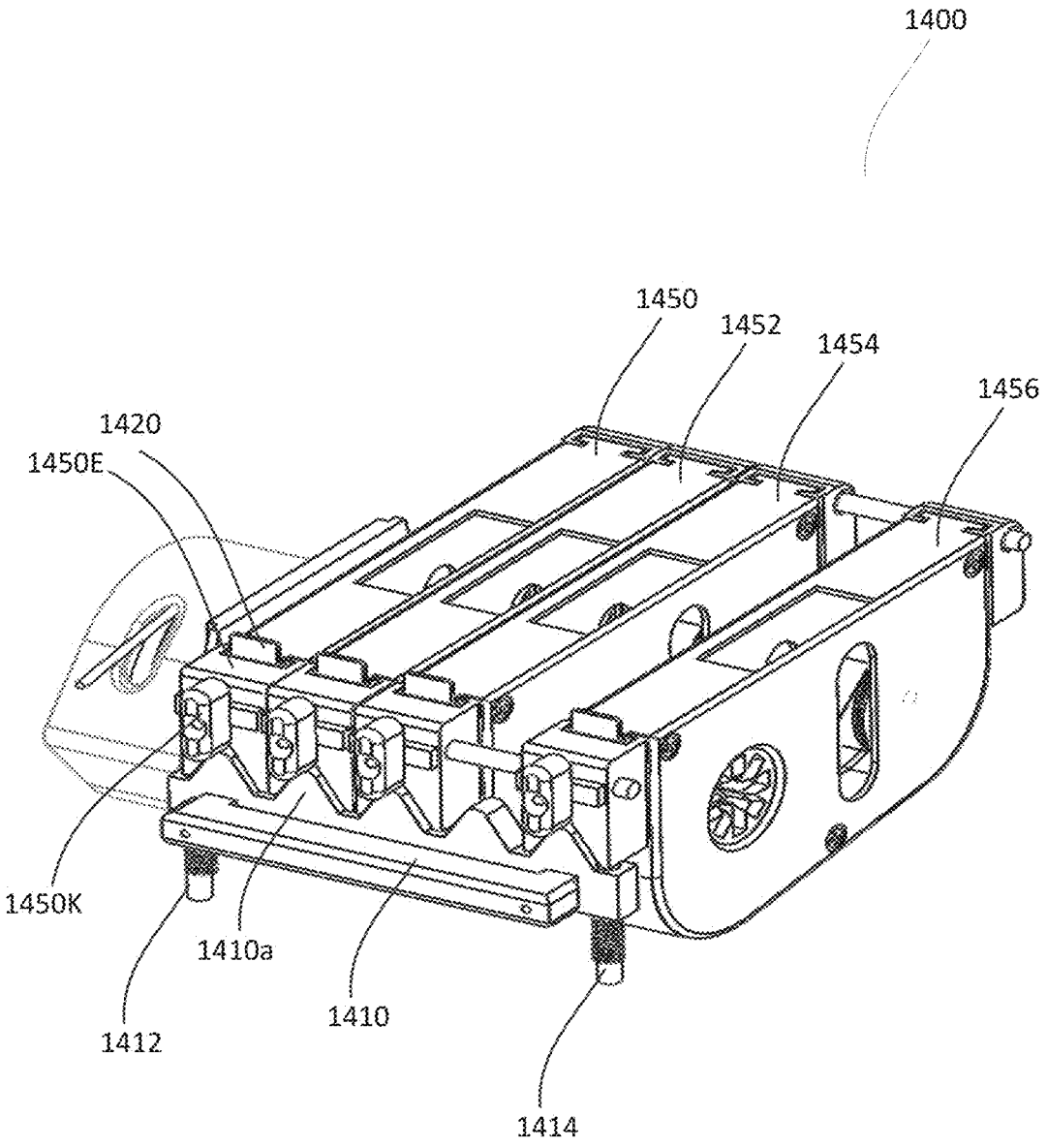
FIG. 14 illustrates another exemplary embodiment of the cable retractor device that includes a bar with grooves for maintaining the switch settings of the device.

In some embodiments, a module tab is provided on the resistance module (e.g. 150, 152, 154). The module tab can be shaped to be easily grasped by the hand of a user. The function of the module tab is to allow a user to easily remove a resistance module (e.g. 150, 152, 154) from module holder (e.g. 150E) when the resistance module needs to be replaced. FIG. 14 depicts an exemplary module tab 1420 for removing the resistance module 1450 from the module holder 1450E.

Figure 10:
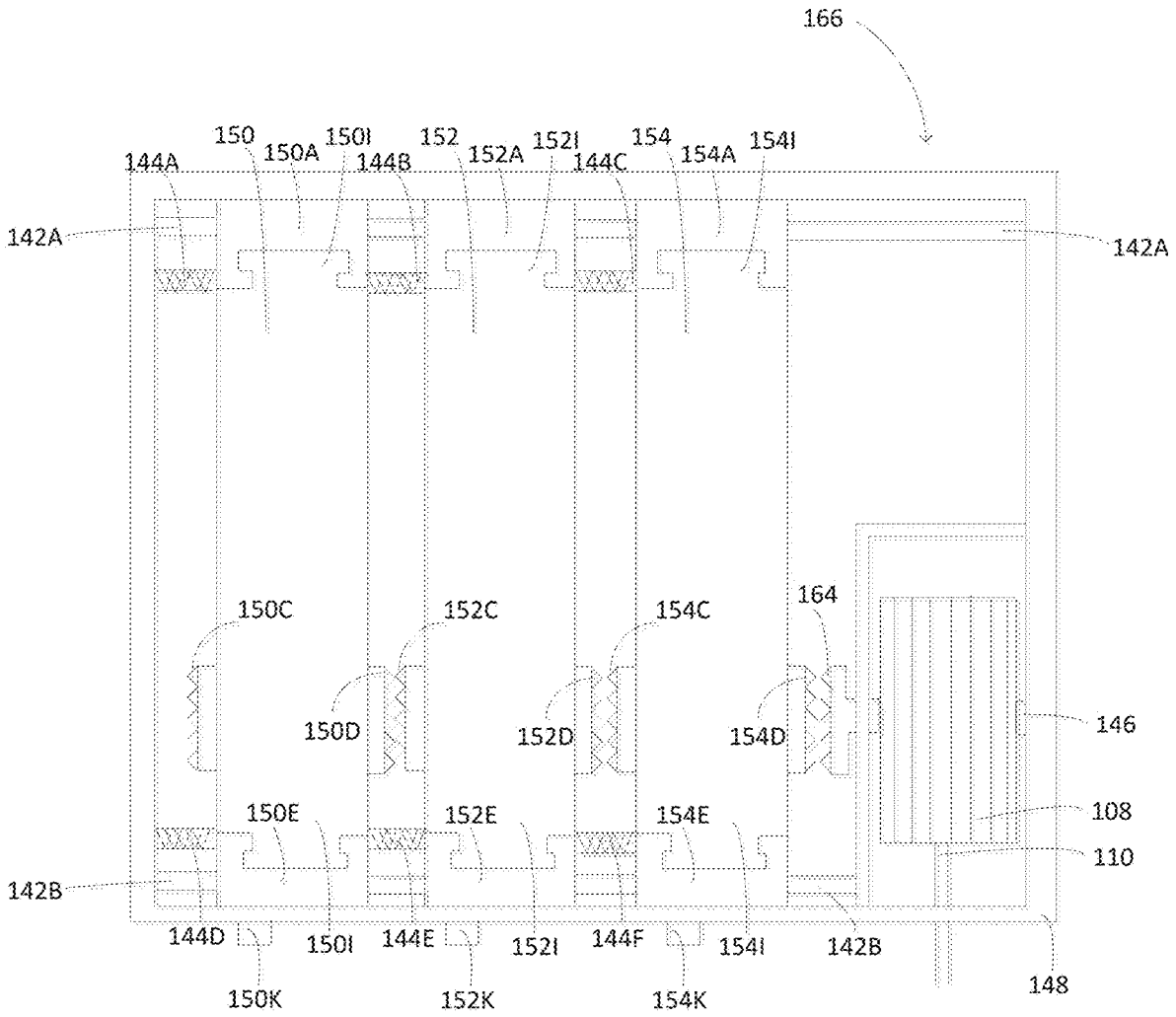
FIG. 10 illustrates another exemplary embodiment of the cable retractor device where the resistance level can be adjusted through the use of switches.
Figure 11:
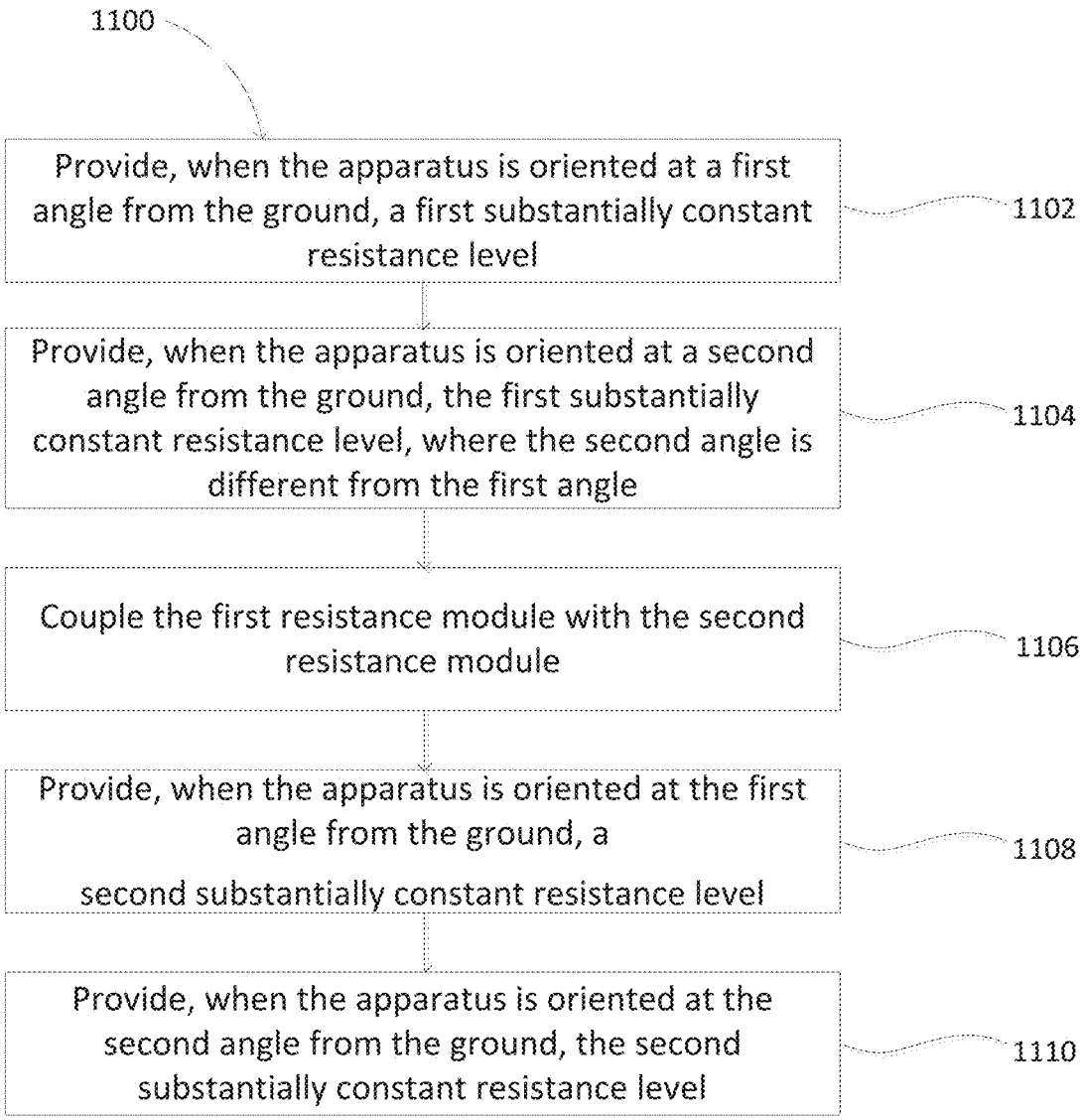
FIG. 11 illustrates a method for using the cable retractor device.

With reference to FIG. 10, the housing 148 includes module holders 150A and 150E that are part of the housing 148, and are configured to stabilize the sliding of the removable resistance modules 150, 152, and 154 along the rods 142A, 142B, 142C, and 142D. In particular, indentations in the housing 148 are configured to align with corresponding protrusions on the module housing (e.g. 1501) such that the module housing can be inserted into the housing 148.

The cord spool cartridge 162 is configured to enclose the cord spool 108 and cord 110. When in action, the rods 142A, 142B, 142C, and 142D pass through the cord spool cartridge 162 and allow the cord spool cartridge 162 to move on the rods 142A, 142B, 142C, and 142D in either direction. The cord spool 108 is mounted on a shaft 146 that runs the width of the cord spool cartridge 162. In one embodiment, the shaft is mounted on bearings on one or both sides of the cord spool cartridge 162. There are interlocking gears 164 on one side of the cord spool cartridge 162 that rotate as the shaft 146 rotates. The shaft 146 rotates as the cord 110 retracts or is pulled off the cord spool 108. The interlocking gears 164 are configured to be coupled with interlocking gears of 154D to change the overall resistance level of the device 140.

In one embodiment, the housing 148 is configured with hinges 156A and 156B and a lid latch 158. Further, a lid may fit into the hinges 156A and 156B and latch to the housing 148 via the lid latch 158. In some embodiments, the lid consists of plastic material and is transparent. When a removable resistance module (e.g., 150, 152, 154) breaks or malfunctions, a lid that is transparent allows a user to visually observe and identify which of the removable resistance modules (e.g., 150, 152, or 154) is broken or malfunctioned. As such, the user can easily replace the broken or malfunctioned removable resistance module by opening the lid, taking the identified removable resistance module (e.g., 150, 152, or 154) out of its module holder (e.g. 150A for removable resistance module 150), and replacing the identified removable resistance module with a new module.

The following describes how the device 140 provides for a constant force exercise where the resistance level is adjustable.

In one embodiment, the user replaces a removable resistance module (e.g. 150, 152, or 154). The user opens the lid attached to the lid latch 158 and the lid hinges 156A and 156B and removes the removable resistance module (150, 152, or 154) by sliding the removable resistance module (150, 152, or 154) out of the module holder, e.g. 150A. The user replaces the removable resistance module (150, 152, or 154) with a new removable resistance module.

The user moves the resistance selector 120 to a first constant resistance level. For the sake of discussion, assume that none of the removable resistance modules 150, 152, and 154 are coupled together or with the interlocking gears 164 of the cord spool cartridge 162. In this configuration, none of the constant force springs in the removable resistance modules (150, 152, 154) are configured to resist the movement of cord 110 off of the cord spool 108. This represents the lowest resistance level for which the device 140 can be configured.

Rotating the adjustment knob 122 in the direction that increases the resistance level results in in the pusher 126 applying force to the cord spool cartridge 162. The force causes the cord spool cartridge 162 to move along the rods 142A-142D. When the rotation selector 120 is rotated far enough, the interlocking gears 164 engage with interlocking gears 154D. When coupled together, the constant force spring of the removable resistance module 154 resists the movement of the cord 110 off of the cord spool 108.

Note that turning the resistance selector 120 to this resistance level does not couple the interlocking gears of removable resistance modules 150 and 152 because of relative load resistance of the compression spring 144A-144C and 144D-144F as described above. In one embodiment, the load resistance of compression springs 144A and 144D is greater than the load resistance of compression springs 144B and 144E. Similarly, the load resistance of compression springs 144B and 144E is greater than the load resistance of compression springs 142C and 142F. As a result, removable resistance module 154 couples before removable resistance module 152 which couples before removable resistance module 150.

The user then pulls the cord 110 off of the cord spool 108. In this configuration, the constant force springs in removable resistance module 154 resists the movement of the cord 110 off of cord spool 108.

The user stops pulling the cord 110, which causes the cord 110 to retract onto the cord spool 108. The cord retracts due to the force produced by the constant force spring in the removable resistance module 154.

The user rotates the resistance selector 120 to a second constant resistance level. Continuing to rotate the resistance selector 120 in the direction that causes the resistance level to increase causes the pusher to force the interlocking gears 152D on removable resistance module 152 to couple with the interlocking gears 154C on removable resistance module 154.

The user pulls the cord 110 off of the cord spool 108. When the interlocking gears 152D and 154C are coupled, the constant force springs in removable resistance modules 152 and 154 both resist the cord 110 being pulled off the cord spool 108.

The user stops pulling the cord 110, which causes the cord 110 to retract onto the cord spool 108. The cord retracts due to the force produced by the constant force springs in removable resistance modules 152 and 154.

Turning the resistance selector 120 in the reverse direction causes the pusher to exert less force on the interlocking gears of the resistance modules causing the interlocking gears of removable resistance modules to uncouple. This causes less removable resistance modules to resist the movement of the cord 110 off of the cord spool 108.

FIG. 10 is a perspective view of another exemplary embodiment of the device. The device 166 includes a housing 148. In this exemplary embodiment, the housing 148 is configured to enclose three resistance modules (e.g., 150, 152, and 154). The housing 148 is also configured to enclose the cord spool 108.

The shaft 146, which is affixed to the housing 148, supports the cord spool 108. The shaft is configured with, at an end of the shaft 146, interlocking gears 164. In some embodiments, to provide optimal rotation of the shaft 146, the shaft 146 is configured with one or more bearings on an end. When in action, the cord 110 can pass through the housing 148 when it is pulled off the cord spool 108.

In some embodiments, the removable resistance modules (e.g., 150, 152, and 154) are configured with switches (e.g., 150K, 152K, 154K) that allow a user to slide the removable resistance modules (e.g., 150,152, 154) along the rods 142A-142B. Specifically, switches 150K, 152K, and 154K are part of the module holders 150E, 152E, and 154E, respectively. Each of the switches protrudes out of the housing 148. When configuring the resistance level of the device 166, the user can move (e.g., slide to the right) switch 154K to move removable resistance module 154 such that the interlocking gears 154D of module 154 couple with the interlocking gears 164 of the shaft 146. To further increase the resistance level, the user can move (e.g., slide to the right) switch 152K to move removable resistance module 152 such that interlocking gears 152D of module 152 couple with the interlocking gears 154C of module 154. To increase the resistance level even further, the user can move switch 150K (e.g., slide to the right) to move removable resistance module 150 such that interlocking gears 150D of module 150 couple with interlocking gears 152C of module 152.

In some embodiments, the switches (e.g., 150K, 152K, 154K) of the removable resistance modules (e.g., 150, 152, 154) are configured with a clip that allows a switch to fit into a slot on an adjacent removable resistance module (e.g., 150, 152, 154) or housing 148. In these embodiments, moving the clip of the switch (e.g., 150K, 152K, 154K) into the slot results in the removable resistance modules (e.g., 150, 152, 154) remaining engaged for the duration of an exercise. FIGS. 22-26 depict an exemplary device having one or more such clips. As depicted in these figures, the device includes switches 150K, 152K, 154K, and 156K for moving four removable resistance modules to adjust the resistance level of the device.

Figure 22:
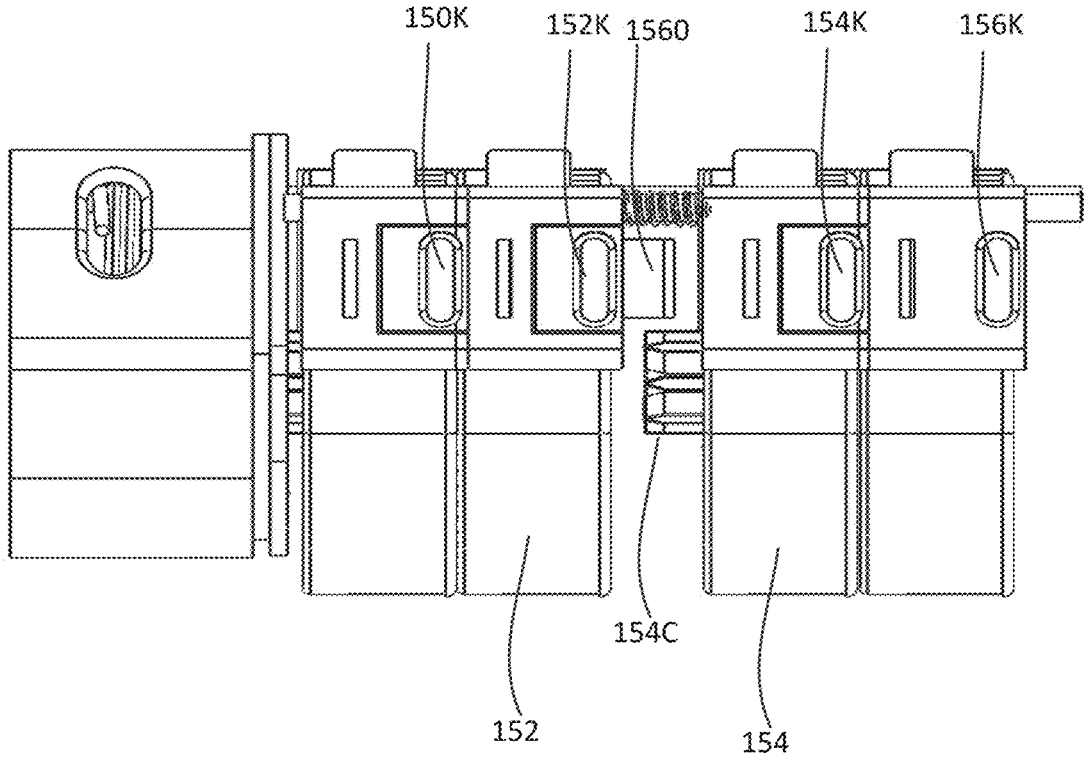
FIG. 22 illustrates a perspective view of another exemplary cable retractor device that includes one or more clips for engaging resistance modules.
Figure 23:
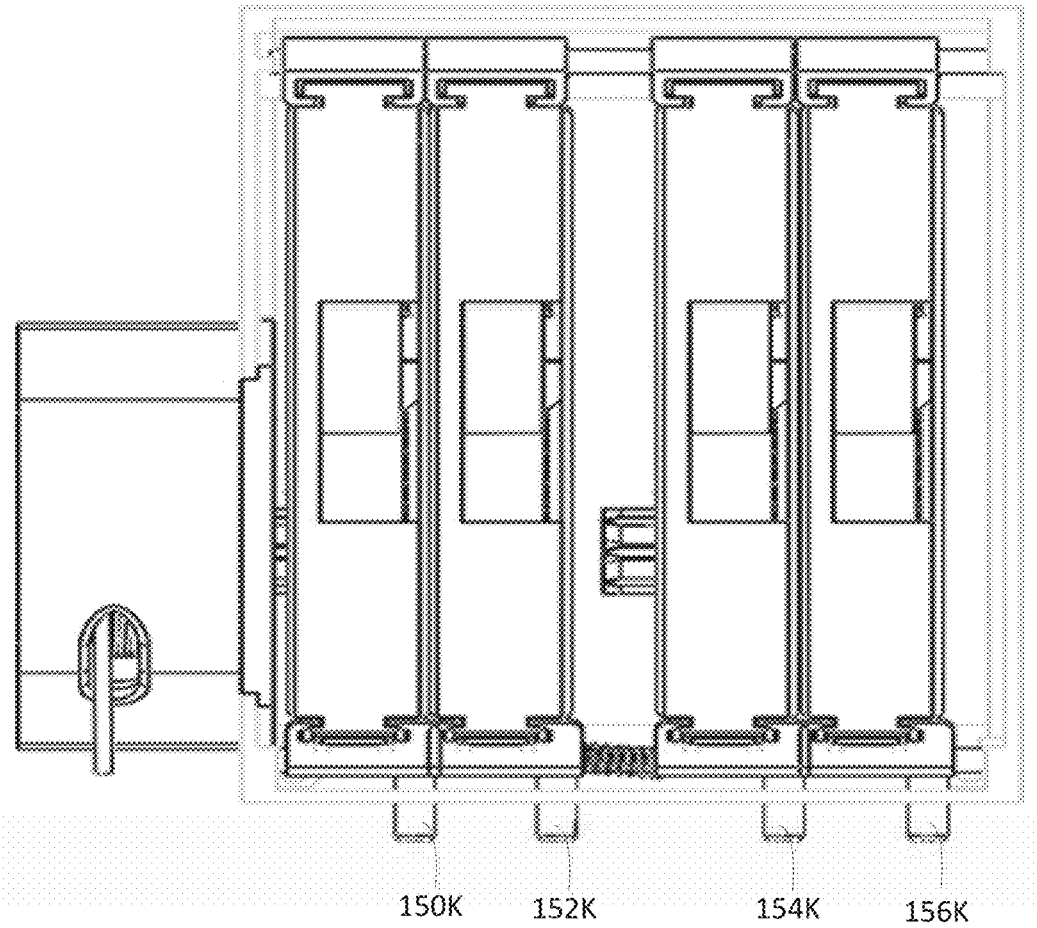
FIG. 23 illustrates another perspective view of the exemplary cable retractor device that includes one or more clips for engaging resistance modules.
Figure 24:
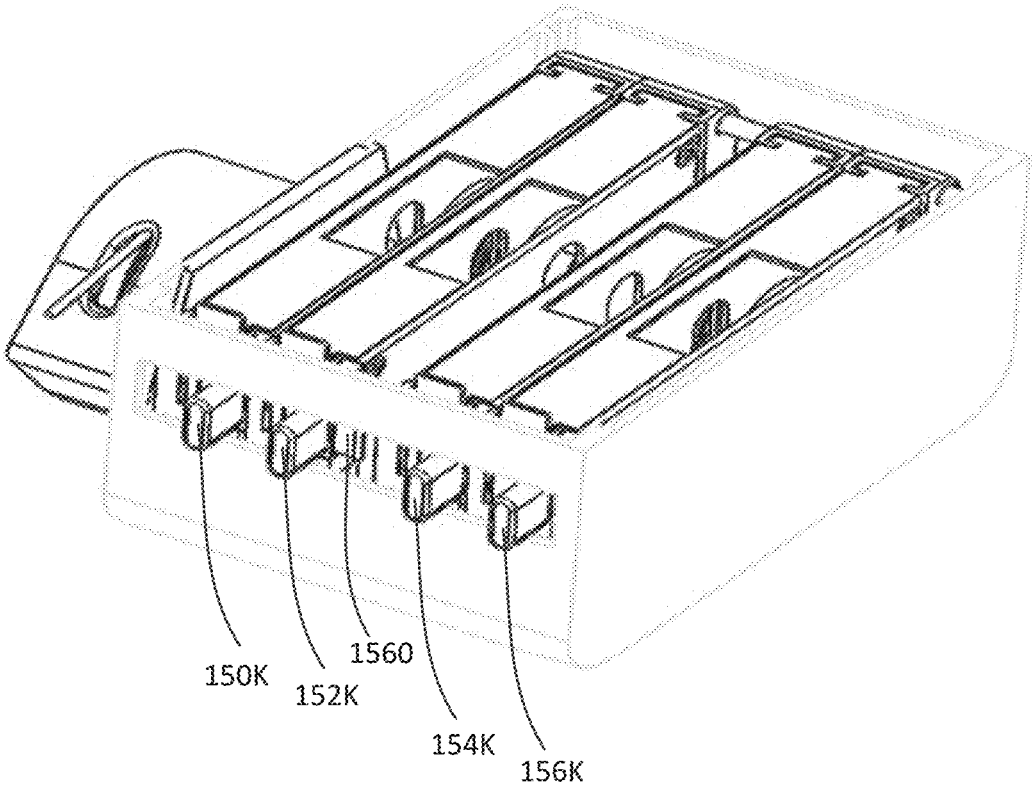
FIG. 24 illustrates another perspective view of the exemplary cable retractor device that includes one or more clips for engaging resistance modules.
Figure 25:
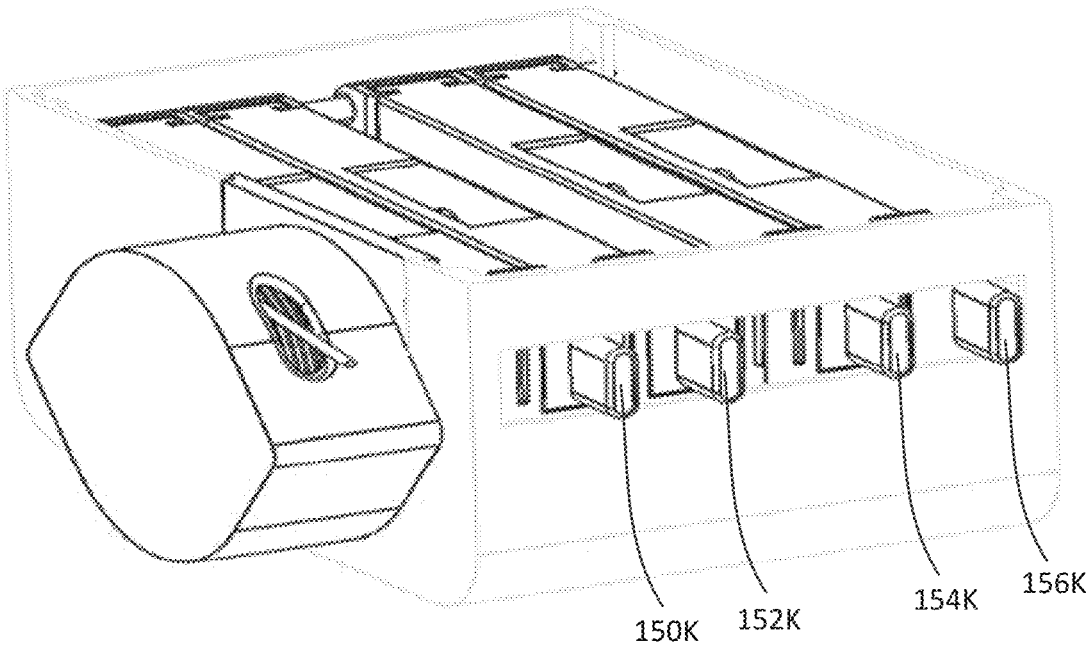
FIG. 25 illustrates another perspective view of the exemplary cable retractor device that includes one or more clips for engaging resistance modules.
Figure 26:
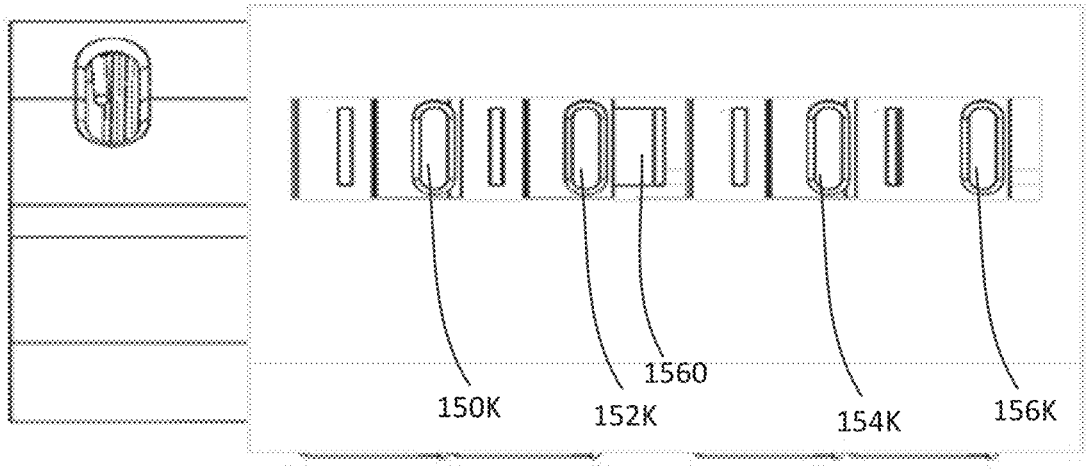
FIG. 26 illustrates another perspective view of the exemplary cable retractor device that includes an exemplary clip for engaging two resistance modules.

As depicted in FIGS. 22, 24, and 26, the resistance module 152 includes a clip 1560 protruding from the right side of the module. As the resistance module 152 and the resistance module 154 become engaged together via interlocking gears (e.g., interlocking gear 154C), the clip 1560 is moved into a slot in the resistance module 154 or the housing to secure the two resistance modules together. To separate two engaged resistance modules 152 and 154, the user may push the switch 154K inward to disengage the clip 1560 from the slot and slide the resistance module 154 away from the resistance module 152.

In some embodiments, as illustrated in FIG. 14, the device 1400 includes a bar 1410 having a plurality of grooves (e.g., 1410*a*) that serve to keep the resistance modules 1450, 1452, 1454, and 1456 and the corresponding module holders (e.g., 1450E) in place. In one embodiment, there are multiple sets of grooves (e.g. on both edges of the resistance module holders) such that the bar can move to further keep the resistance modules and module holders in place. The bar can be on the side, bottom, middle or other locations on the device. In the depicted embodiment, two rods 1412 and 1414 pass through the bar 1410, thus allowing the bar 1410 with grooves (e.g., 1410*a*) to slide along the rods. As depicted, rods 1412 and 1414 each has a spring to keep the bar 1410 with grooves in position such that the switches (e.g., 1450K) cannot be switched between set and unset positions. When the user pushes downward on the bar 1410, the springs are compressed and the bar 1410 with grooves can be moved downward such that the switches can be switched from a set position (in which the switches cannot be moved by the user) to an unset position (in which the switches can be moved by the user). When the user releases the bar 1410 with grooves, the springs 1412 and 1414 force the bar with grooves back into a position where the switches (e.g., 1450K) of the resistance modules cannot be moved by the user.

One of ordinary skill in the art would understand that the bar 1410 may not operate as intended if the bar 1410 is not configured correctly. For example, the springs 1412 and 1414 may resist the user's push and, rather than causing the bar 1410 to slide downward to put the resistance modules into an unset position, cause the whole device to tilt. FIGS.

27-31 illustrate alternative mechanisms for switching the resistance modules between a set position (in which they cannot be moved by the user) and an unset position (in which they can be moved by the user).

Figure 27:
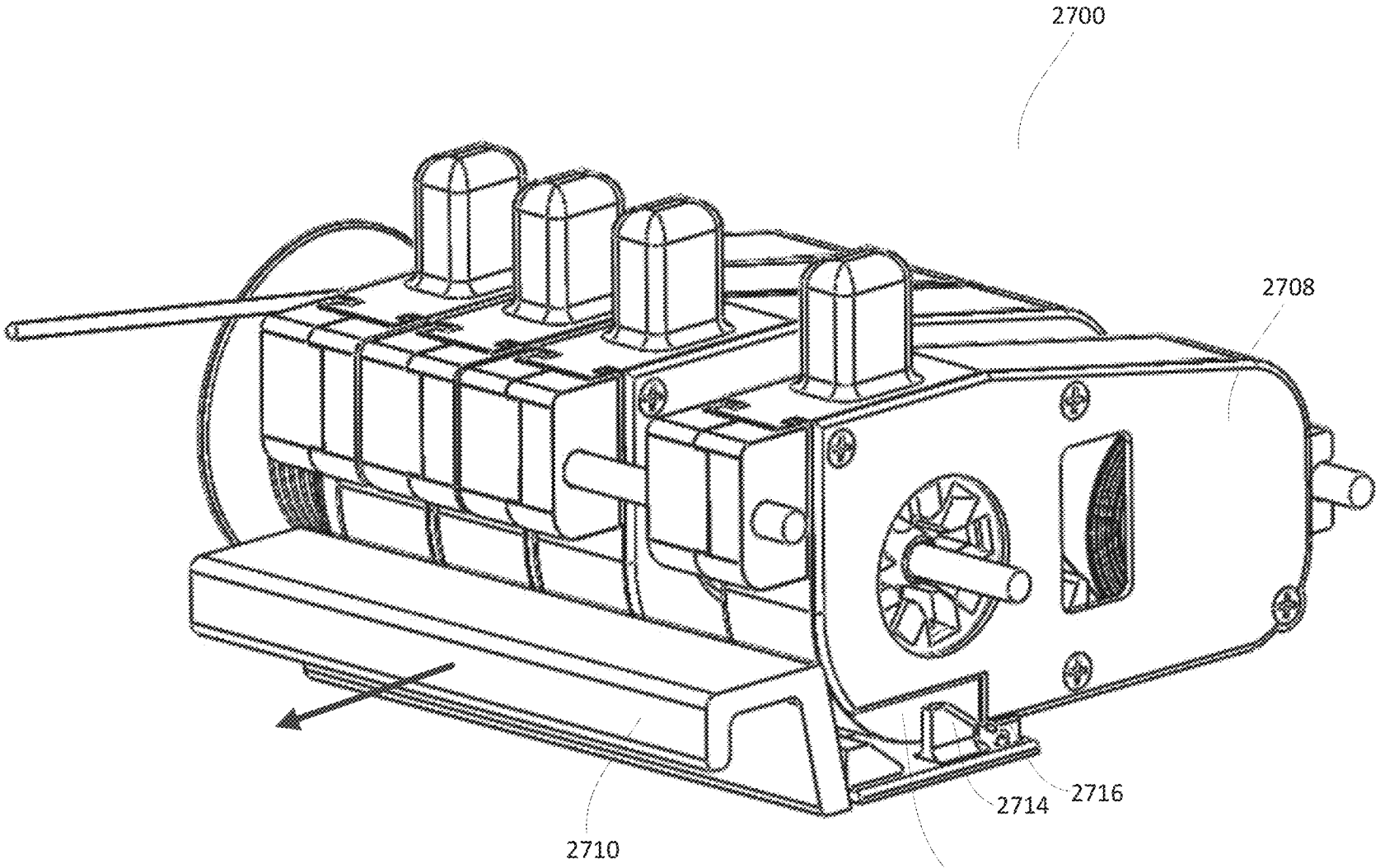
FIG. 27 illustrates a perspective view of another exemplary cable retractor device that includes a bar for maintaining the switch settings of the device.

FIG. 27 illustrates an exemplary cable retractor device 2700 that includes a bar 2710 for switching the resistance modules between a set position and an unset position. Unlike the bar 1410 of the device 1400, the bar 2710 is designed to be pulled out rather than being pulled down. The bar 2710 is attached to a flat bottom piece, on which a set of teeth such as tooth 2714 and tooth 2716 are disposed. As shown in FIG. 27, when the bar is not pulled out, the teeth 2714 and 2716 engage with the resistance module 2708 via a cutout 2702 on the side surface of the resistance module. It should be appreciated that other teeth are disposed on the bottom piece to keep each of the resistance modules in place in a similar manner. As such, when the bar is not pulled out, the resistance modules are in a set position and cannot be moved relative to each other.

Figure 28:
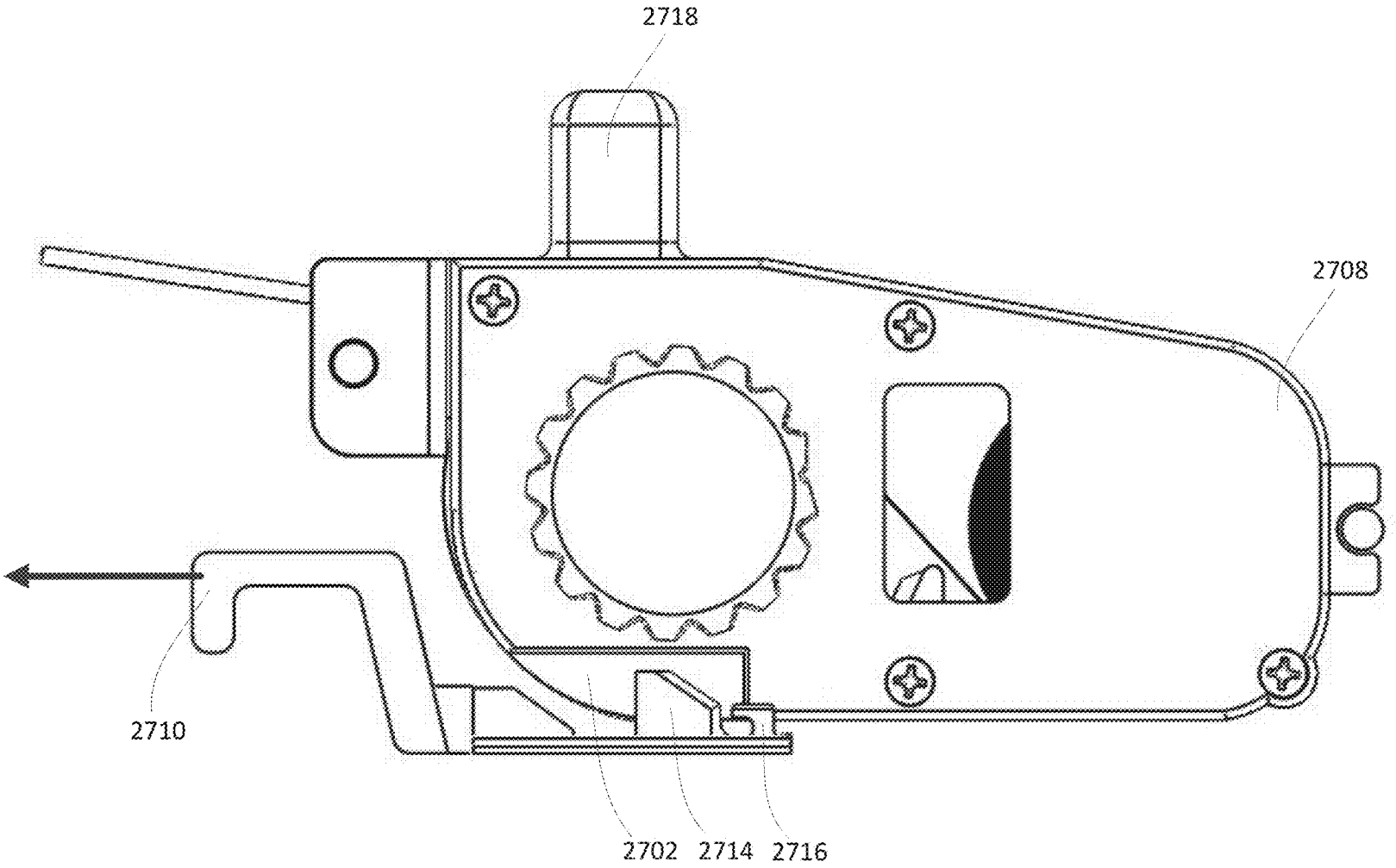
FIG. 28 illustrates a side view of the exemplary cable retractor device that includes a bar for maintaining the switch settings of the device.
Figure 29:
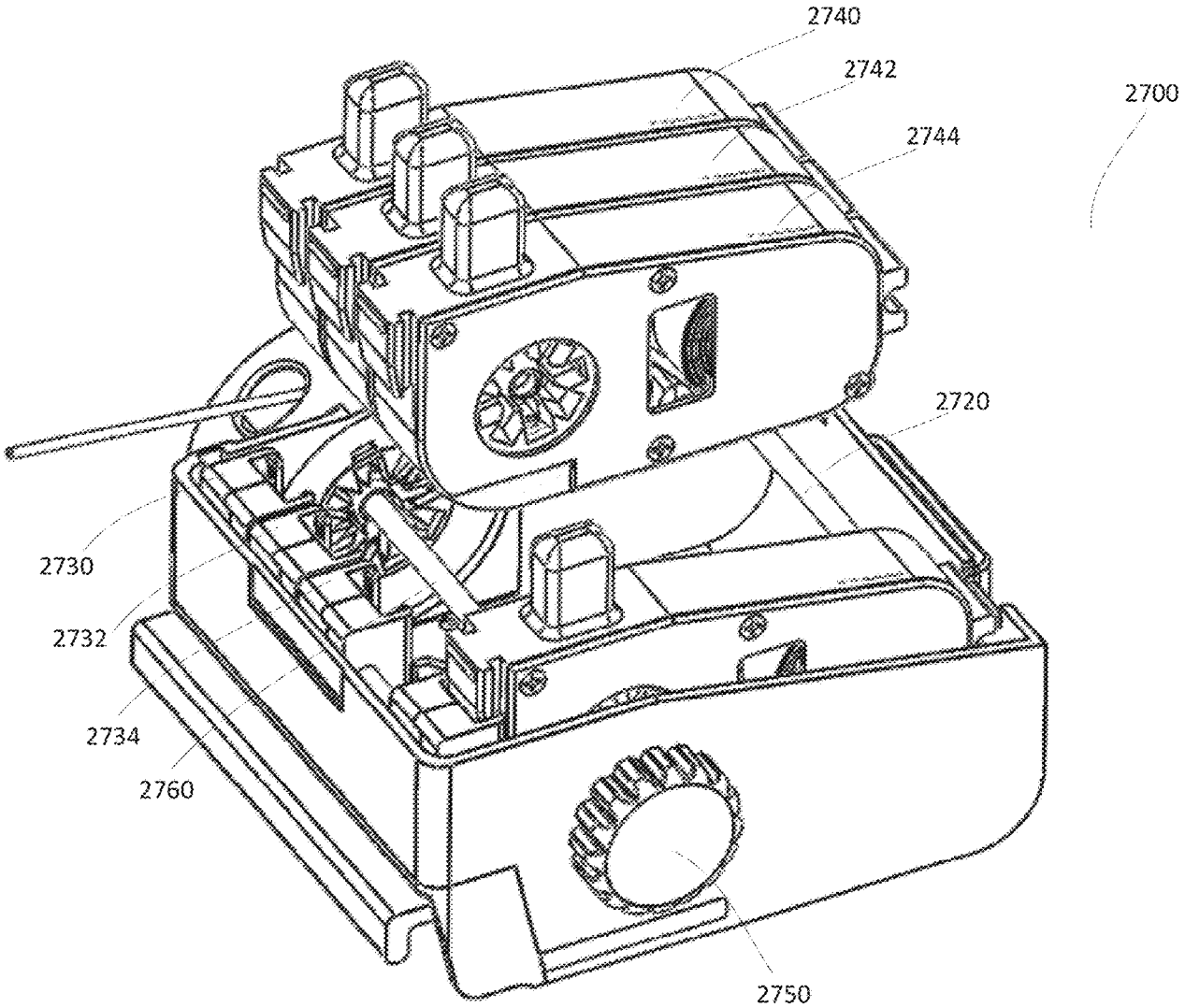
FIG. 29 illustrates another perspective view of the exemplary cable retractor device that includes a bar for maintaining the switch settings of the device.

Turning to FIG. 28, when the user pulls out the bar 2710 as indicated by the arrow, the bottom piece, along with the teeth 2714 and 2716 disposed on the bottom piece, becomes disengaged from the resistance module 2708. As the bar 2710 is pulled out, the bottom piece moves downward relative to the cutout 2702 and the teeth 2714 and 2716 are no longer in contact with the cutout 2702, thus switching the resistance modules to an unset position. In the unset position, the user can grab switch 2718 located on the top of the resistance module 2708 and slide the resistance module to engage with or disengage from a neighboring resistance module.

It should be appreciated that each of the resistance modules in the device 2700 may be removed and replaced with a different resistance module, for example, one providing a different resistance level. As depicted in FIG. 30, resistance modules 2740, 2742, and 2744 may be inserted into module holders 2730, 2732, and 2734, respectively. In some examples, before replacing any resistance modules, the shaft 2760 needs to be removed (e.g., pulled out via pusher 2750) so that the replacement resistance module(s) can be dropped in. As shown, after the resistance modules are dropped in, the resistance modules are held by a rail 2720 on the backside of the device.

Figure 30A:
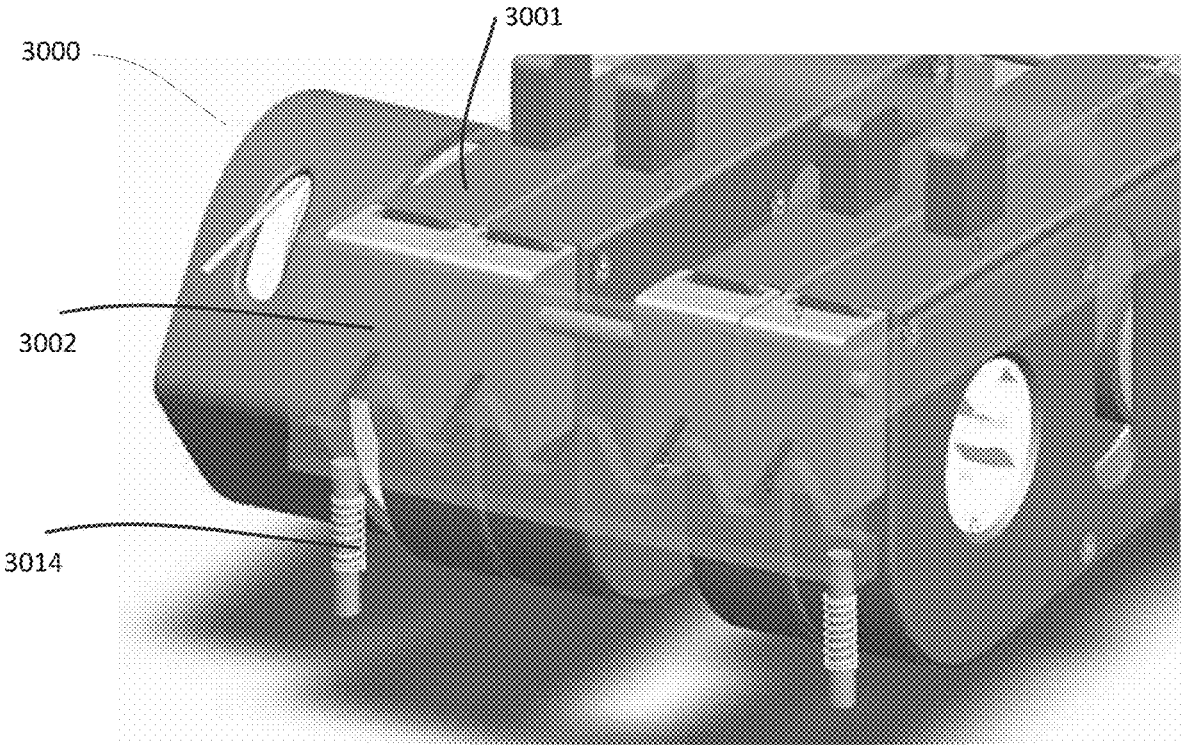
FIG. 30A illustrates a perspective view of another exemplary cable retractor device that includes a bar structure for maintaining the switch settings of the device.

FIG. 30A illustrates another alternative mechanism for switching resistance modules between a set position (in which they cannot be moved by the user) and an unset position (in which they can be moved by the user). Device 3000 includes four resistance modules, each of which is held in a resistance module holder. For example, resistance module 3001 is held by resistance module holder 3002. The resistance module holder 3002 includes a wedge-shaped groove toward the bottom.

Figure 30B:
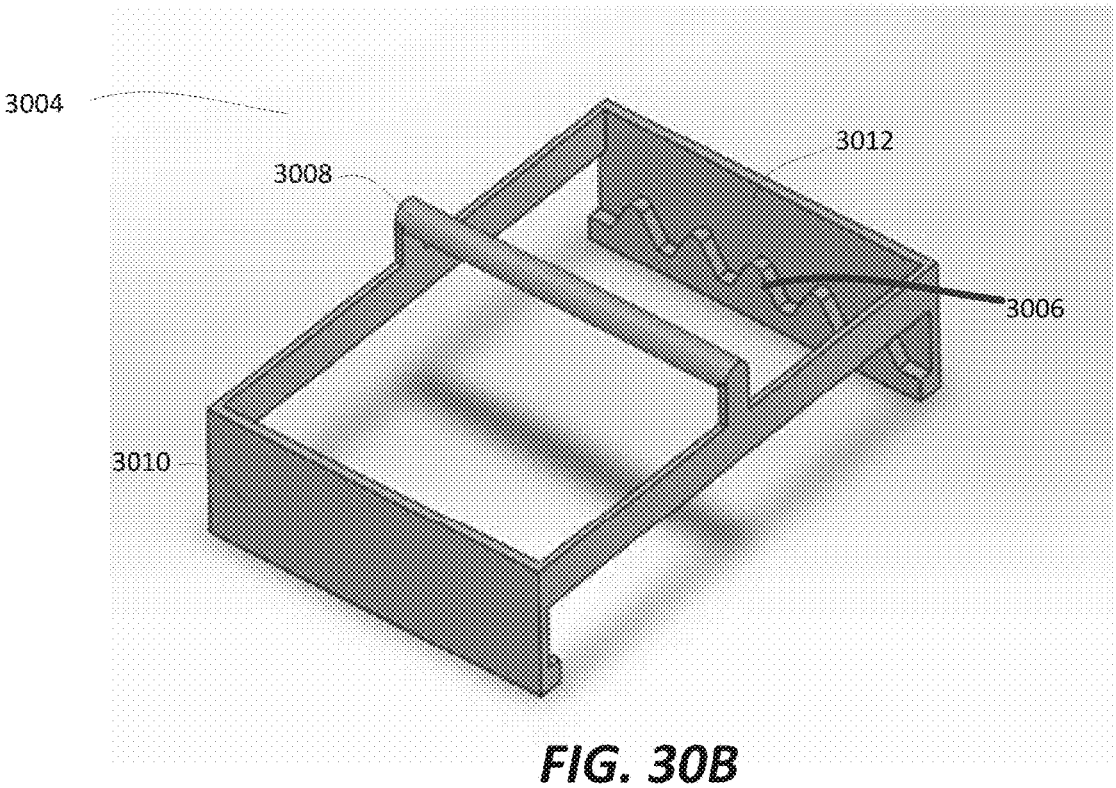
FIG. 30B illustrates a perspective view of the bar structure for maintaining the switch settings of the device.

The device 3000 also includes a bar structure 3004 as depicted in FIG. 30B. The bar structure includes two lateral surfaces 3010 and 3012, each of which includes a set of grooves (e.g., 3006). Turning back to FIG. 30A, the bar structure 3004 is placed over and around the four resistance modules. By way of the loaded springs (e.g., spring 3014), the grooves on the lateral surfaces of the bar structure 3004 (shown as transparent) press up against the grooves of the resistance module holders to keep the resistance module holders in a set position. Accordingly, the resistance modules are secured in place and cannot be moved relative to each other.

Figure 31:
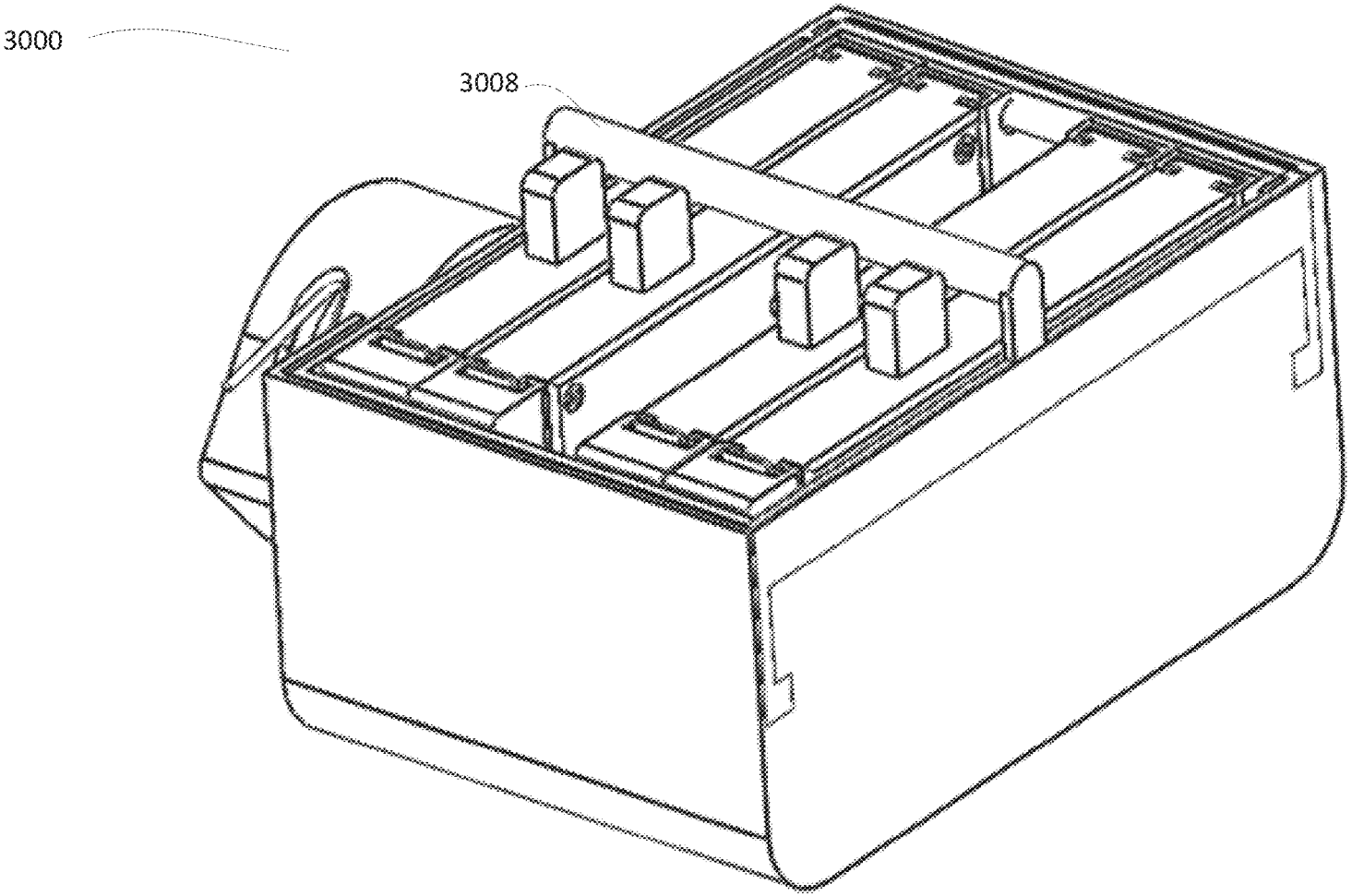
FIG. 31 illustrates another perspective view of the exemplary cable retractor device that includes a bar structure for maintaining the switch settings of the device.

To switch the resistance modules into an unset position, the user can push the bar structure downward using the top handle 3008, as depicted in FIG. 31. After the bar structure is pushed down, the grooves of the bar structure are no longer pressed up against the resistance module holders, allowing the user to slide the resistance modules (e.g., via the switches on the top of the resistance modules) to adjust the resistance level of the device.

Figure 32B:
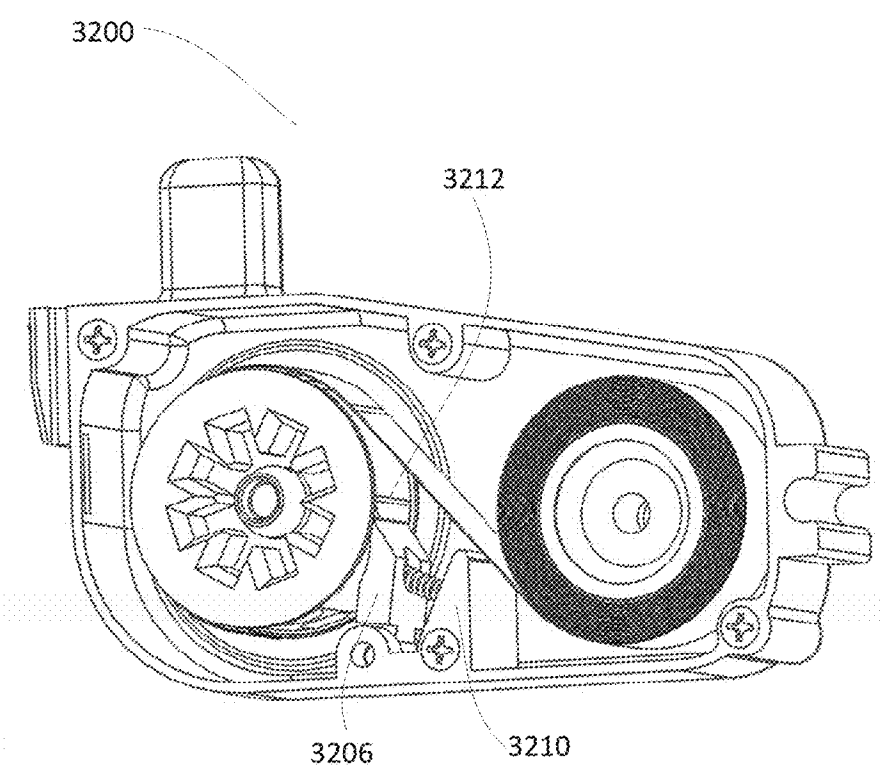
FIG. 32B illustrates another side view of the exemplary resistance module that includes a stopper for preventing the constant force spring from being over-pulled.
Figure 32A:
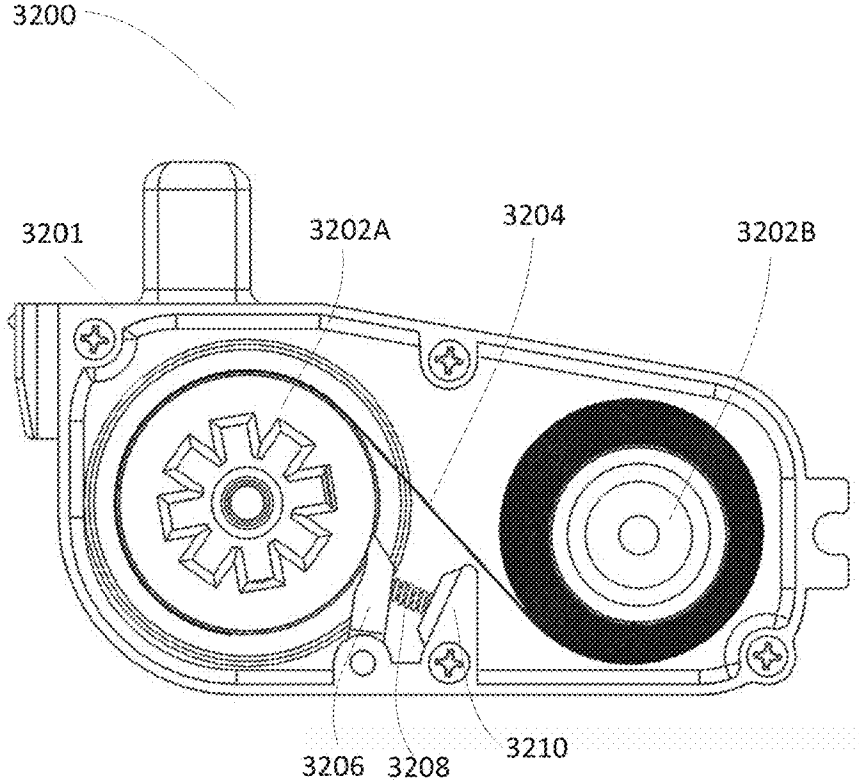
FIG. 32A illustrates a side view of another exemplary resistance module that includes a stopper for preventing the constant force spring from being over-pulled.

FIG. 32A illustrates a side view of an exemplary resistance module that includes a stopper for preventing the constant force spring from being over-pulled. The removable resistance module 3200 includes a housing 3201, a constant force spring 3204, a first storage drum 3202A, and a second storage drum 3202B. A support 3210 protrudes from the inner surface of the housing and is connected to a stopper 3206 via a loaded spring 3208. When the resistance module is in operation, the constant force spring 3204 unwinds from the storage drum 3202A and winds onto the storage drum 3202B as the user pulls the cable. As shown in FIG. 32B, the storage drum 3202A includes a slot 3212 and, when the constant force spring 3204 is unwound such that the slot 3212 is exposed, the stopper 3206 inserts into the slot 3212, thus preventing the constant force spring from being unwound from the storage drum 3202A further. This mechanism prevents the constant force spring from being unwound completely from the storage drum 3202A and thus being bent backward, thus improving the durability of the constant force spring.

The description below describes the use of the device, according to one embodiment. The description may describe any one of the embodiments discussed above, or independent of any previously discussed embodiments.

With reference to FIG. 10, the user replaces the removable resistance module (150, 152, or 154). In one embodiment, the user opens lid attached to lid latch 158 and lid hinges 156A and 156B and removes a removable resistance module (150, 152, or 154) by sliding the removable resistance module (150, 152, or 154) out of the cartridge holder 150A. The user replaces the removable resistance module (150, 152, or 154) with a new removable resistance module.

The user sets the device to a first constant resistance level. The following description assumes that the device 166 is set to the minimum resistance level. At the minimum resistance level, none of the interlocking gears 150C-154C, 150D-154D, and 164 are coupled. Since there is no coupling, none of the removable resistance modules 150, 152, and 154 resist the movement of the cord 110 off of the cord spool 108. This configuration represents the lowest resistance level of device 166.

Each switch 150K, 152K, and 154K is associated with a resistance module holder 150E, 152E, and 152E. When switch 154K moves from the unset position to the set position, the resistance module holder 154E along with the entire resistance module 154 moves along the rods 142A, 142B, 142C, and 142D towards the cord spool 108. The interlocking gears 154D engage with the interlocking gears 164. When coupled together the resistance module 154 resists the movement of the cord 110 off of the cord spool 108. This configuration represents the second lowest resistance level since the constant force spring of removable resistance module 154 is now configured to resist the movement of the cord 110 off of the cord spool 108.

Note that moving the switch 154K from the unset position to the set position does not couple the interlocking gears 152D of removable resistance modules 152 with the interlocking gears 154C of removable resistance module 154. Also, moving the switch 154K from the unset position to the set position does not couple the interlocking gears 150D of removable resistance modules 150 with the interlocking gears 152C of removable resistance module 152.

The user pulls the cord off of the cord spool. The device 166 provides resistance at a constant level because of the constant force spring in removable resistance module 154. The user is able to pull the cord off of the cord spool when the user applies enough force to exceed the opposing force provided by the constant force spring.

The device 166 retracts the cord 110 onto the cord spool 108. The cord 110 will retract onto the cord spool 108 when the user ceases to apply force that opposes that caused by the constant force springs in the device 166.

The user moves the switch 152K to a second constant resistance level. When switch 152K moves from the unset position to the set position, the resistance module holder 152E along with the entire removable resistance module 152 moves along the rods 142A, 142B, 142C, and 142D towards the cord spool 108. The interlocking gears 152D engage with the interlocking gears 154C. When coupled together, the removable resistance modules 152 and 154 resist the movement of the cord 110 off of the cord spool 108. This configuration represents the third lowest resistance level that device 166 provides.

The user pulls the cord 110 off of the cord spool 108. The device 166 provides resistance at a constant level because of the constant force springs in removable resistance modules 152 and 154. The user is able to pull the cord 110 off of the cord spool 108 when the user applies enough force to exceed the opposing force provided by the constant force springs.

The device 166 retracts the cord 110 onto the cord spool 108. The cord 110 will retract onto the cord spool 108 when the user ceases to apply force that opposes that caused by the constant force springs in the device 166.

The resistance level can also be set to a lower level. When switch 152K moves from the set position to the unset position, the resistance module holder 152E along with the entire removable resistance module 152 moves along the rods 142A, 142B, 142C, and 142D away from the cord spool 108. The interlocking gears 152D disengage with the interlocking gears 154C. When resistance modules 152 and 154 are decoupled, only the resistance module 154 is coupled to the cord spool 108. This configuration represents the second lowest resistance level that the device 166 provides.

When switch 154K moves from the set position to the unset position, the resistance module holder 154E along with the entire resistance module 154 moves along the rods 142A, 142B, 142C, and 142D away from the cord spool 108. The interlocking gears 154D disengage with the interlocking gears 164. When resistance module 154 and the cord spool 108 are decoupled, no resistance module resists the movement of the cord 110 off of the cord spool 108. This configuration represents the lowest resistance level that the device 166 provides.

Figure 12:
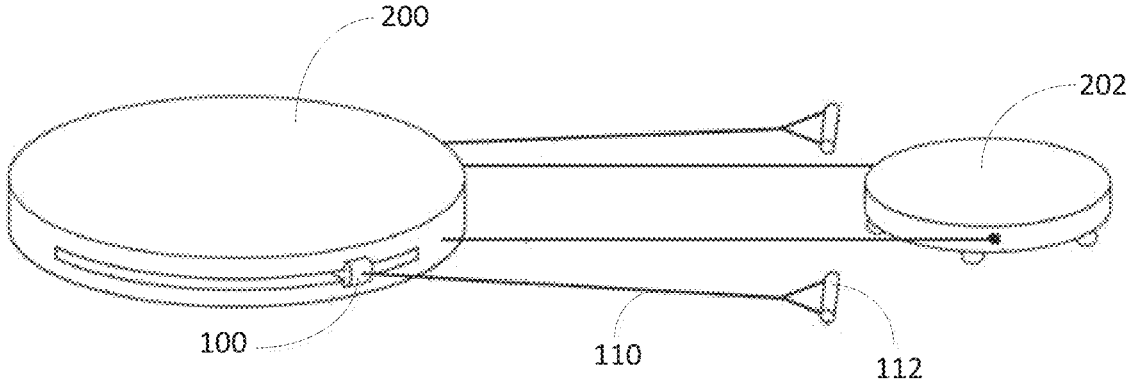
FIG. 12 illustrates an exemplary cable retractor device, configured for use with an exemplary Pilates fitness system, used at an angle that is parallel to the ground.
Figure 13:
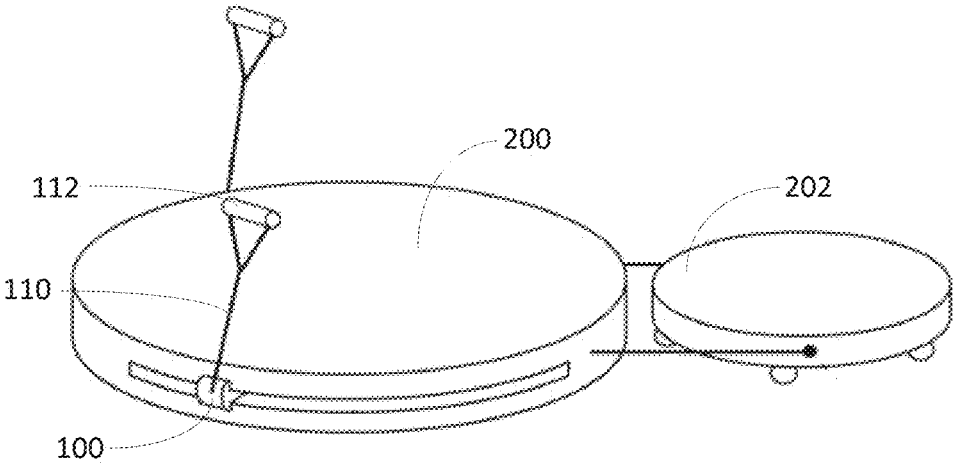
FIG. 13 illustrates an exemplary cable retractor device, configured for use with an exemplary Pilates fitness system, used at an angle that is perpendicular to the ground.

FIGS. 12 and 13 display another embodiment of the invention. In FIG. 12 the device 100 is connected to a first user support platform 200, which is attached to a second user support platform 202 via cables. In FIG. 12, the cord 110 and handle 112 are at an orientation roughly parallel with the ground. When the user pulls on the handle 112 the device 100 provides resistance at a first resistance level. The first resistance level is based on the sum of the resistance level of each resistance module coupled together and with the cord spool.

Similarly, in FIG. 13, the device 100 is connected to a first user support platform 200, which is attached to a second user support platform 202 via cables. In FIG. 12, the cord 110 and handle 112 are at an orientation roughly perpendicular with the ground. When the user pulls on the handle 112 the device 100 provides resistance at a first resistance level. The first resistance level when the handle is pulled parallel to the ground is nearly identical as the load provided when the handle is pulled perpendicular to the ground. There might be slight differences in the resistance provided by the device 100 in different orientations due to factors like friction, but the resistance level.

When the user adjusts increases the resistance, this causes additional resistance modules to couple together. When the user pulls handle 112 at the same orientation the device 100 provides resistance at a second resistance level. The second resistance level is based on the sum of the resistance level of each resistance module coupled together and with the cord spool.

Figure 15:
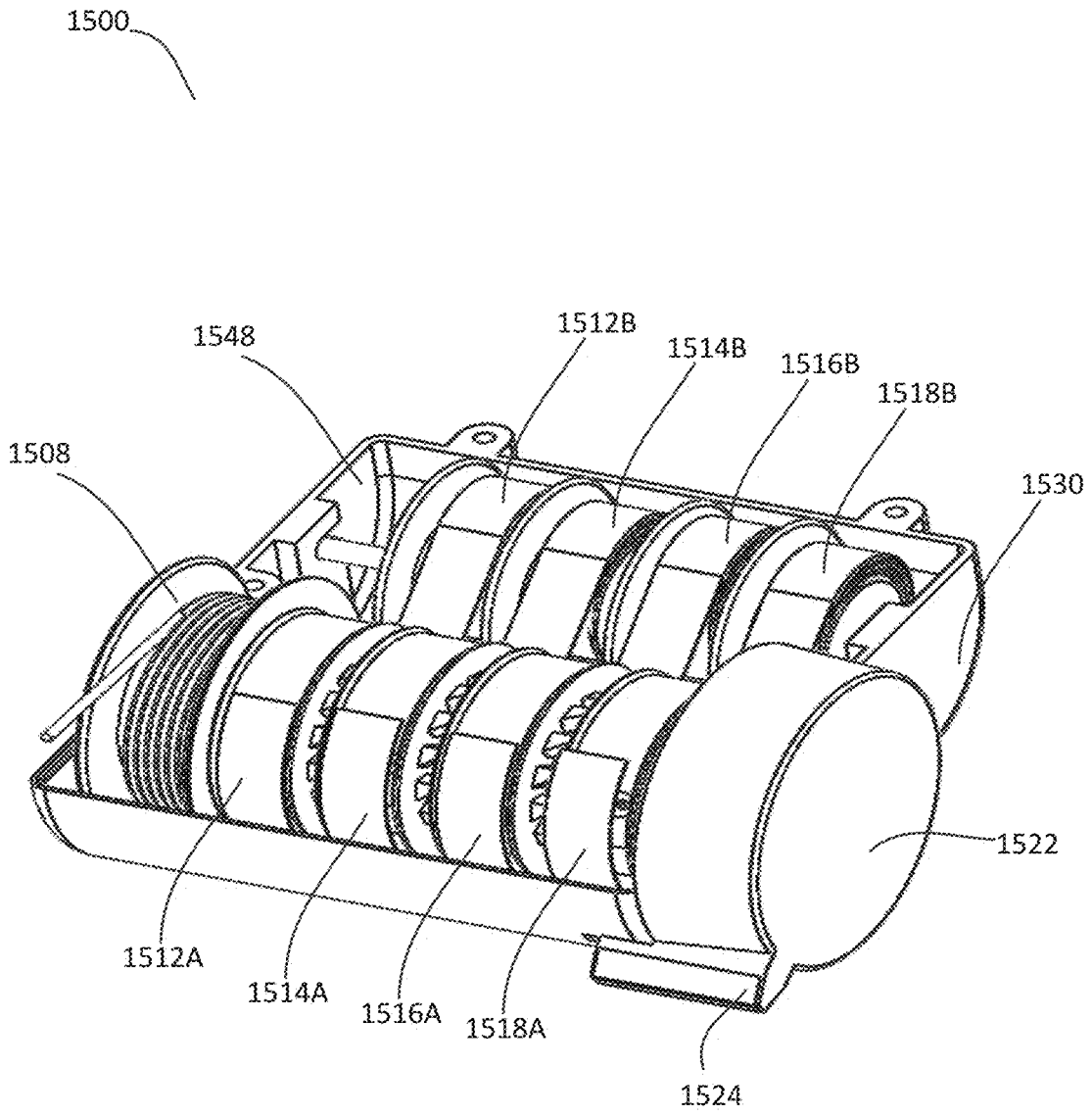
FIG. 15 illustrates a perspective view of another exemplary cable retractor device that includes multiple movable pieces enclosing springs.
Figure 16:
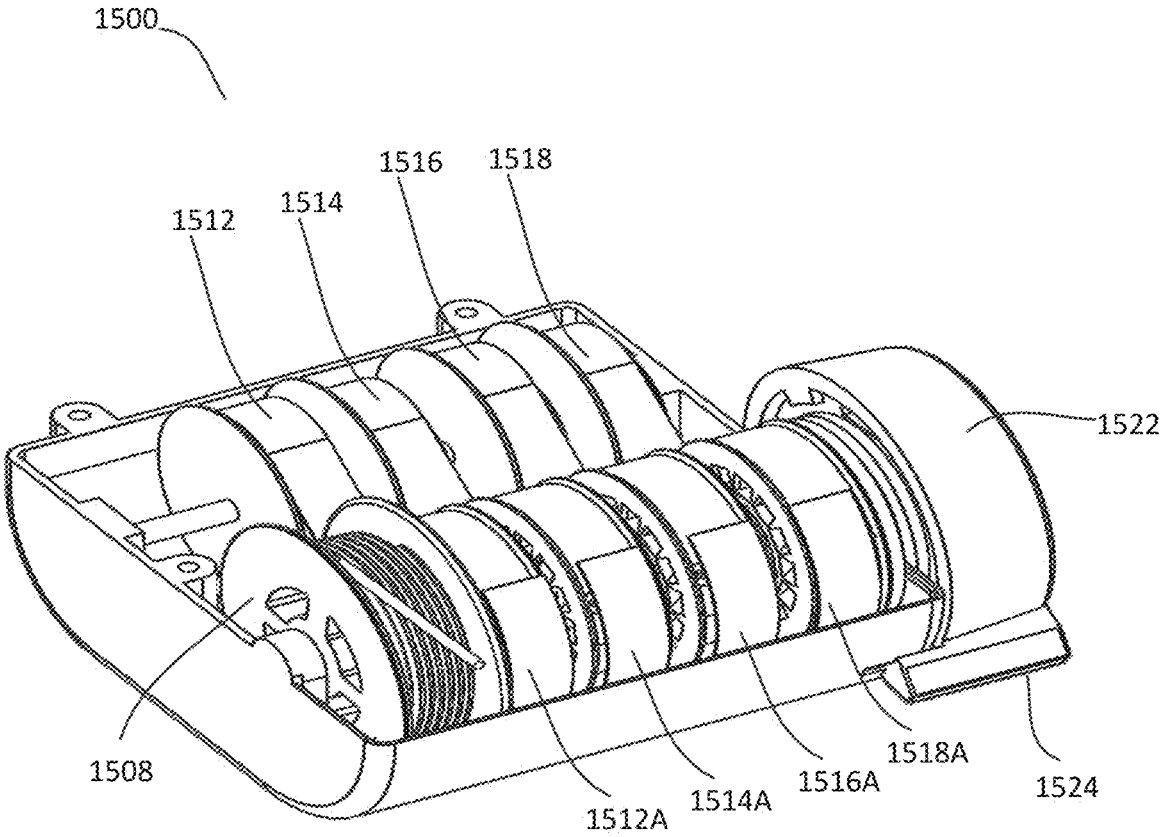
FIG. 16 illustrates another perspective view of the exemplary cable retractor device that includes multiple movable pieces enclosing springs.

FIGS. 15 and 16 are perspective views of another exemplary cable retractor device. The device 1500 includes a housing 1548. Enclosed within the housing 1548 are storage drums 1512A-B, 1514A-B, 1516A-B, 1518A-B, and a cord spool 1508 with a cord wrapping around the spool. Four constant force springs are wound on the storage drums. The constant force springs are a commercially available type of spring that provides nearly a constant load throughout the spring range of motion, as discussed above. In the depicted embodiment, each constant force spring is configured to be in an S-shape arrangement, wrapping around the first corresponding storage drum in one direction and wrapping around the second corresponding storage drum in the opposite direction.

The device 1500 further includes a resistance selector. The resistance selector includes an adjustment knob 122 that may be rotated by the user to adjust the resistance level of the device. The adjustment knob includes a resistance indicator 1524 that displays a visual indication of the current overall resistance level.

Figure 17:
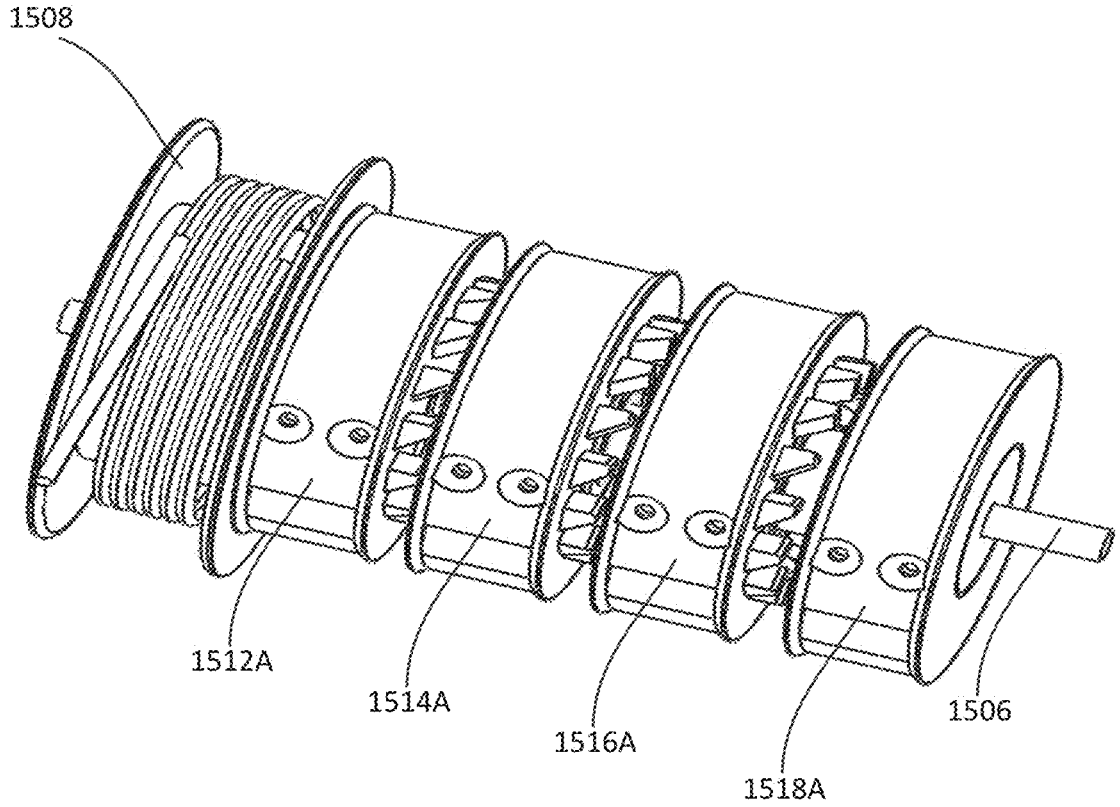
FIG. 17 illustrates a perspective view of the drums of the resistance modules of the exemplary cable retractor device that includes multiple movable pieces enclosing springs.

FIG. 17 illustrates an exemplary set of storage drums that may be coupled with each other to create different resistance levels. The set of storage drums includes 1512A, 1514A, 1516A, and 1518A placed on a shaft 1506, with a cable spool 1508 attached to the storage drum 1512A. As shown, each of storage drums 1512A, 1514A, 1516A, and 1518A includes an engagement pattern (i.e., a set of teeth) on one side in a manner similar to FIG. 3. Further, each of storage drums 1514A, 1516A, and 1518A includes another engagement pattern (i.e., a set of holes) on the opposite side in a manner similar to FIG. 4, such that a set of teeth on one drum can fit into corresponding holes on the adjacent drum. In the depicted example, the storage drum 1512A is permanently attached to the cable spool 1508 such that there is a minimum, first level of resistance to pulling out the cable.

Figure 18A:
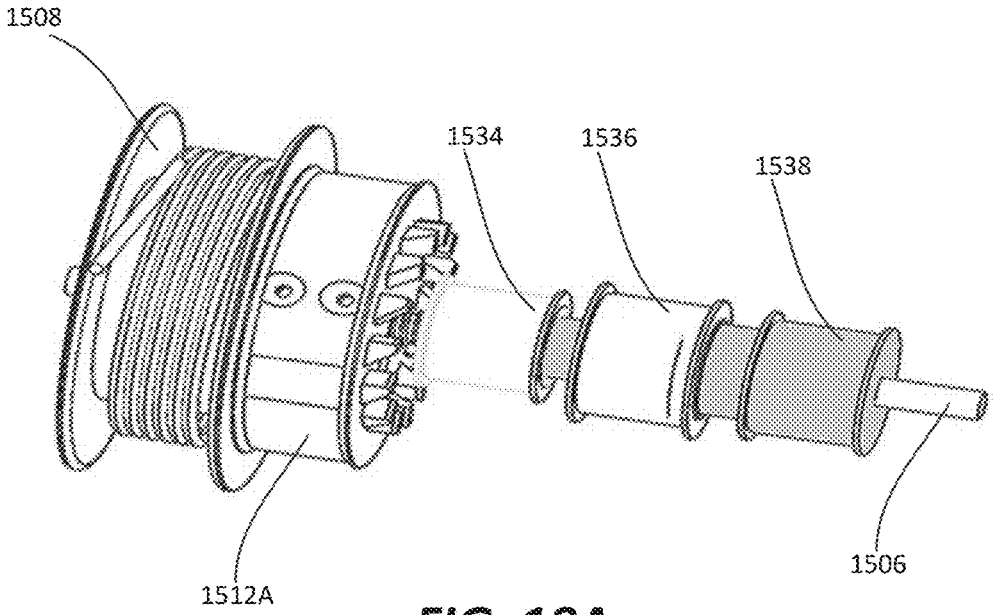
FIG. 18A illustrates a perspective view of the movable pieces enclosing springs of the exemplary cable retractor device.
Figure 18B:
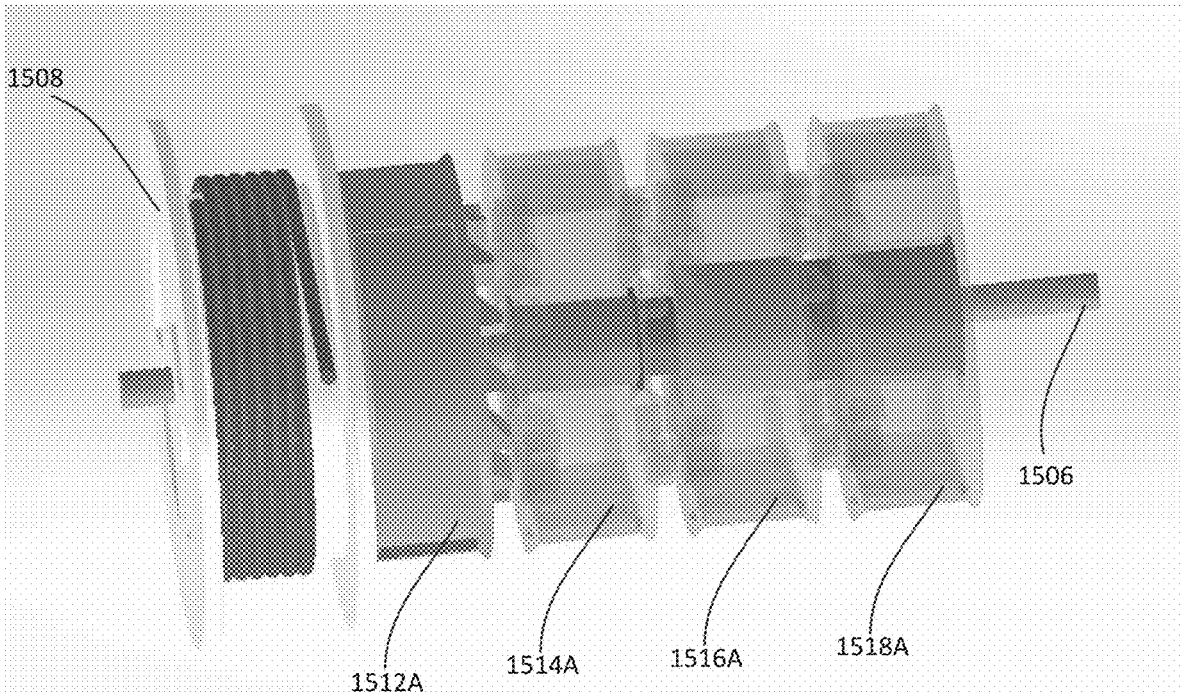
FIG. 18B illustrates another perspective view of the movable pieces enclosing springs of the exemplary cable retractor device.

Unlike the embodiment depicted in FIG. 2, the storage drums 1514A, 1516A, and 1518A do not have direct contact with the shaft 1506. Rather, these storage drums are disposed over multiple movable pieces, which can move along the longitudinal axis of the shaft 1506 and allow for better control over the positioning and engagement of storage drums. As depicted in FIG. 18A, movable pieces 1534, 1536, and 1538 are disposed over shaft 1506. In particular, the movable piece 1536 is disposed over an elongated portion of the movable piece 1538. Further, as depicted in FIG. 18B, storage drums 1514A, 1516A, and 1518A are affixed to the movable pieces 1534, 1536, and 1538, respectively.

Figure 20:
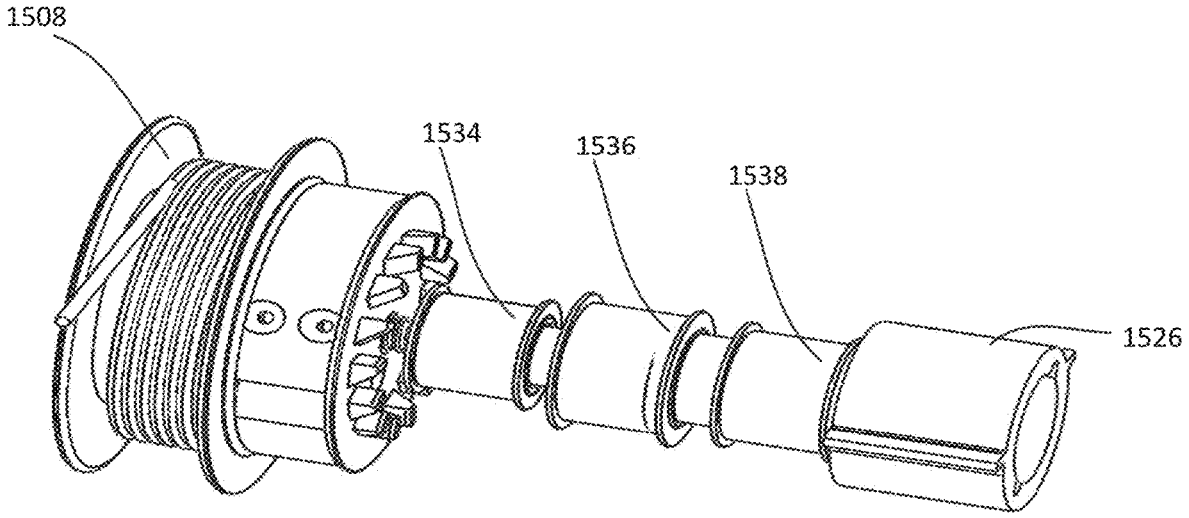
FIG. 20 illustrates another perspective view of the movable pieces enclosing springs of the exemplary cable retractor device.
Figure 21:
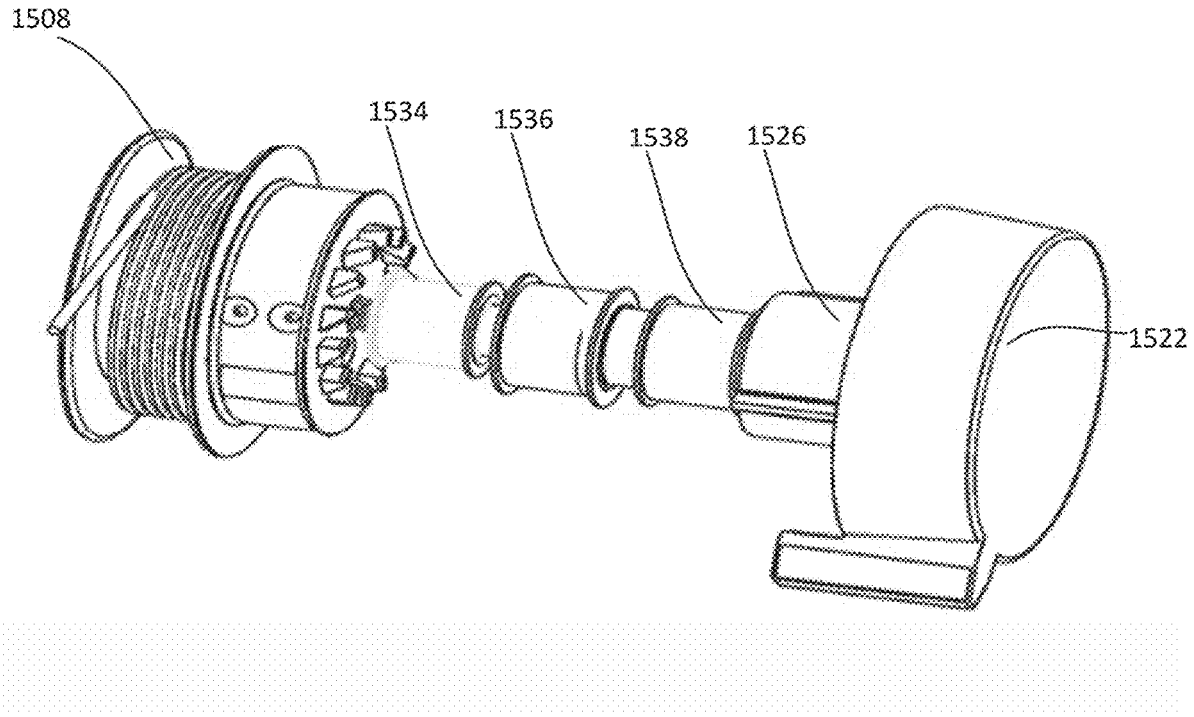
FIG. 21 illustrates another perspective view of the movable pieces enclosing springs of the exemplary cable retractor device.

In some embodiments, the movable piece 1538 is affixed to a resistance selector, which comprises an adjustment knob 1522 and a pusher 1526, as illustrated in FIGS. 20 and 21. The resistance selector may operate in a similar manner as described with reference to FIG. 5. When the user rotates the adjustment knob 1522, the pusher 1526 is forced to move along the shaft in a direction determined by the direction that the resistance selector is rotated.

Figure 19A:
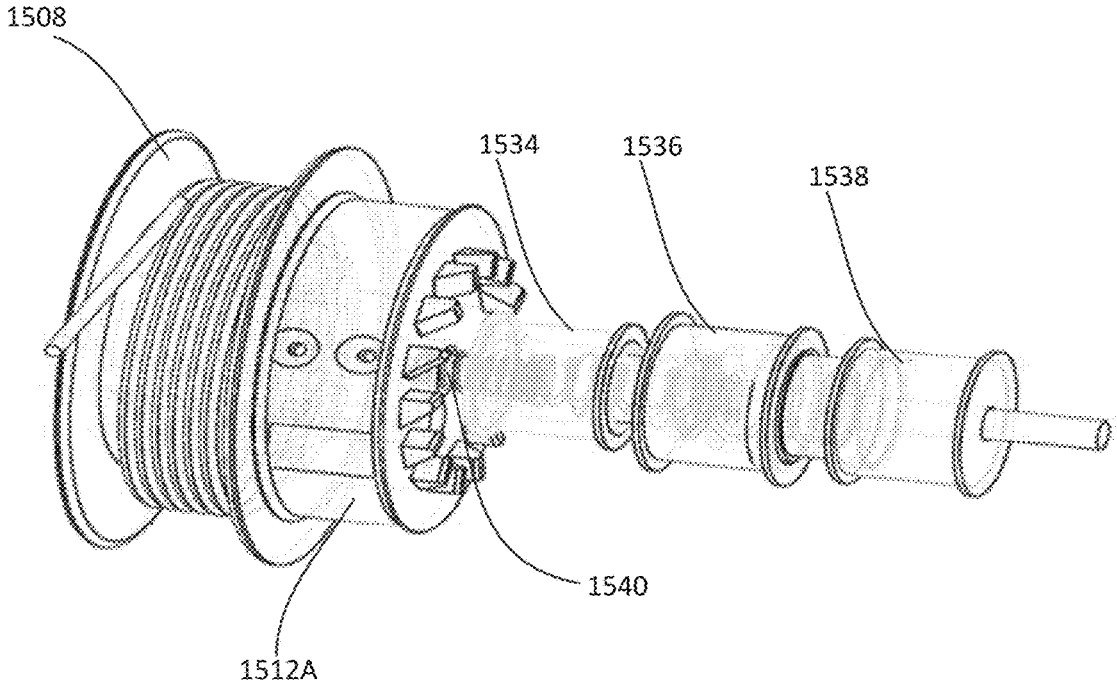
FIG. 19A illustrates another perspective view of the movable pieces enclosing springs of the exemplary cable retractor device.
Figure 19B:
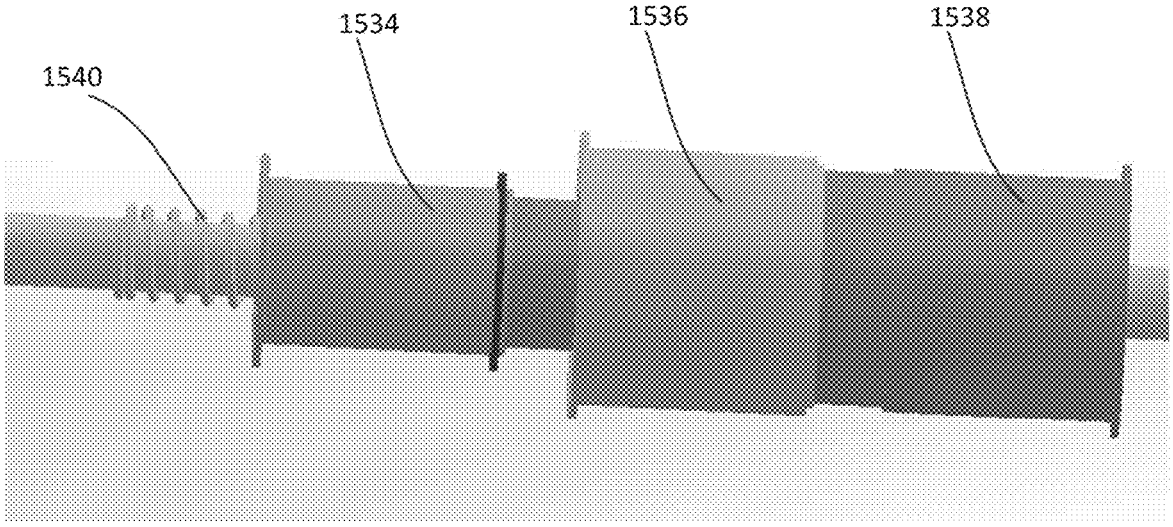
FIG. 19B illustrates another perspective view of the movable pieces enclosing springs of the exemplary cable retractor device.
Figure 19C:
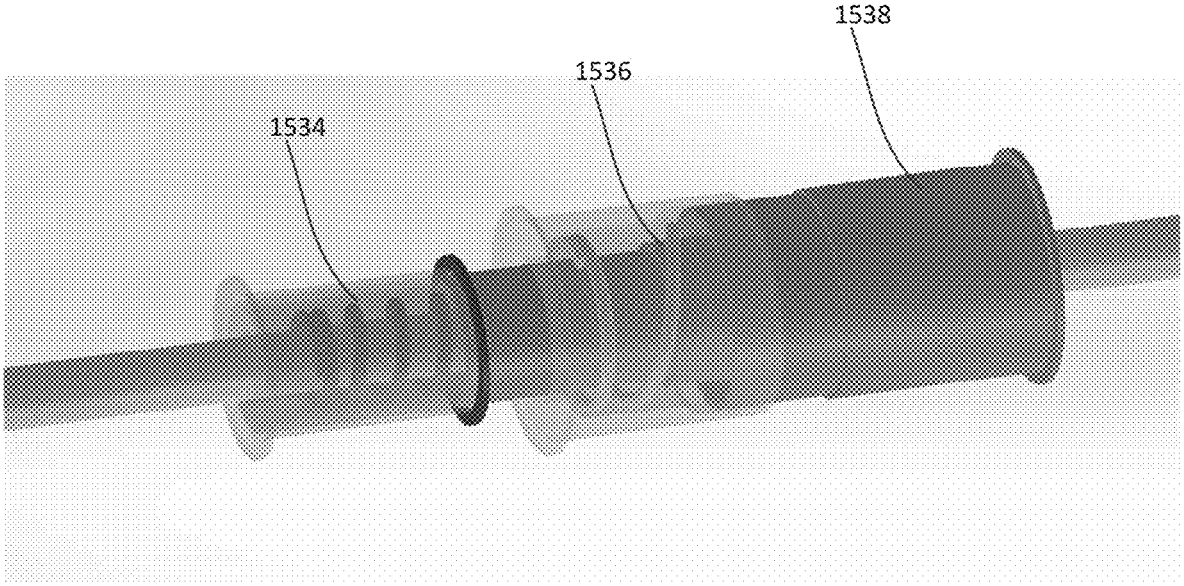
FIG. 19C illustrates another perspective view of the movable pieces enclosing springs of the exemplary cable retractor device.

FIGS. 19A-C illustrates the operation of movable pieces 1534, 1536, and 1538. As the user rotates the adjustment knob (not depicted) to engage the storage drums, a spring 1540 is compressed and the movable pieces 1534, 1536, and 1538 (along with the storage drums affixed to the movable pieces) all move in the direction toward the cable spool 1508. As the spring 1540 is retracted into the movable piece 1534, the storage drum 1514A, which is affixed to the movable piece 1534, becomes engaged with the cable spool 1508 and the permanently attached storage drum 1512A. In this configuration, if the user pulls the cord, the device will provide a second level of resistance provided by the constant force strings around the storage drums 1512A and 1514A. The spring 1540 is configured to push the assembly of movable pieces back to their original position when the adjustment knob is turned in reverse.

When the storage drums 1512A and 1514A are engaged together, the movable piece 1534 cannot move further toward the cable spool. As the user continues rotating the adjustment knob, the movable piece 1534 partially collapses into the movable piece 1536 and the storage drum around the movable piece 1534 is engaged with the storage drum around the moving piece 1536. In this configuration, if the user pulls the cord, the device will provide a third level of resistance provided by the constant springs around the storage drums 1512A, 1514A, and 1516A.

As the user continues rotating the adjustment knob, the movable piece 1538 is the only movable piece that continues to move toward the cord spool, allowing the storage drum 1518A to become engaged with the storage drum 1516A. In this configuration, if the user pulls the cord, the device will provide a fourth and highest level of resistance provided by the constant springs around the storage drums 1512A, 1514A, 1516A, and 1518A.

FIG. 19C depicts the movable pieces 1534 and 1536 as transparent to show the internal springs that return these pieces to their original positions to disengaged the movable pieces. It should be appreciated that more springs and more layers to this assembly may be added to enable additional resistance levels. Unlike embodiments shown in FIGS. 8 and 10, in which resistance modules are configured to slide along shaft(s) to engage and disengage with each other, the embodiments shown in FIGS. 15-21 move the storage drums via internal springs, thus reducing the friction (e.g., introduced by the shaft) and making the adjustment process easier and less error-prone.

Figure 33A:
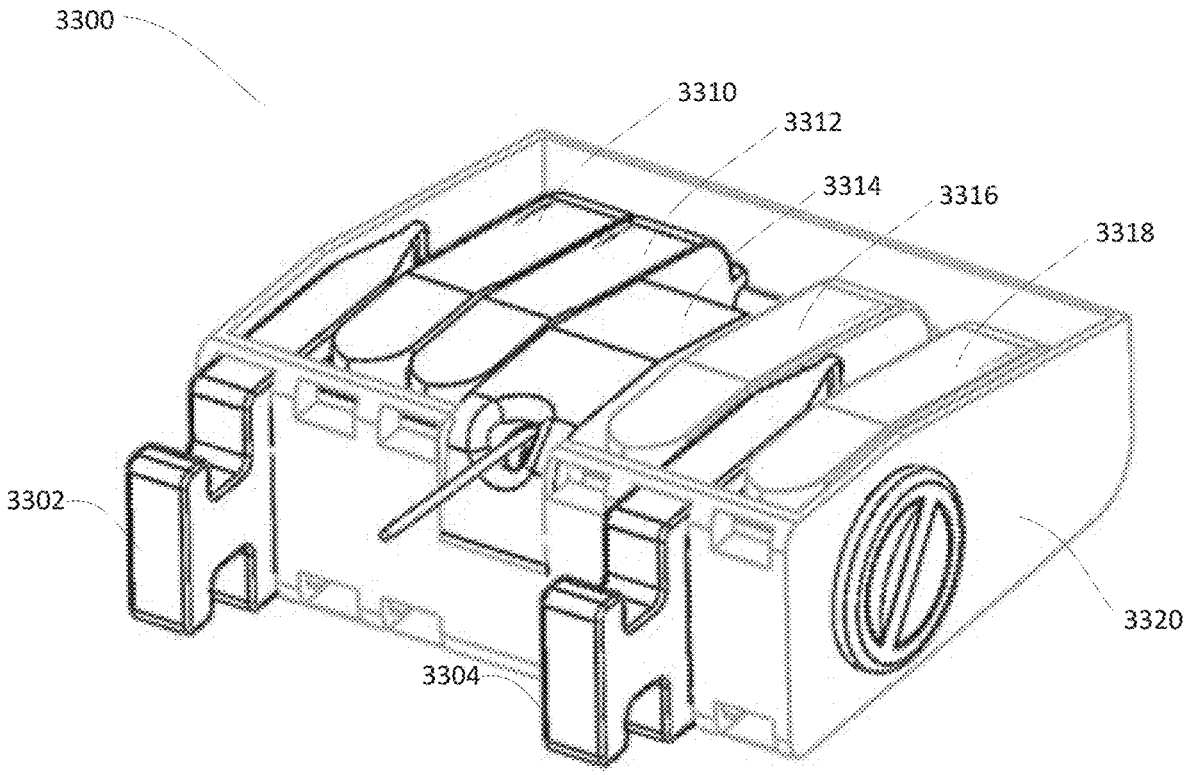
FIG. 33A illustrates a perspective view of another exemplary cable retractor device that includes multiple detachable key pins for setting the resistance level of the device.
Figure 33B:
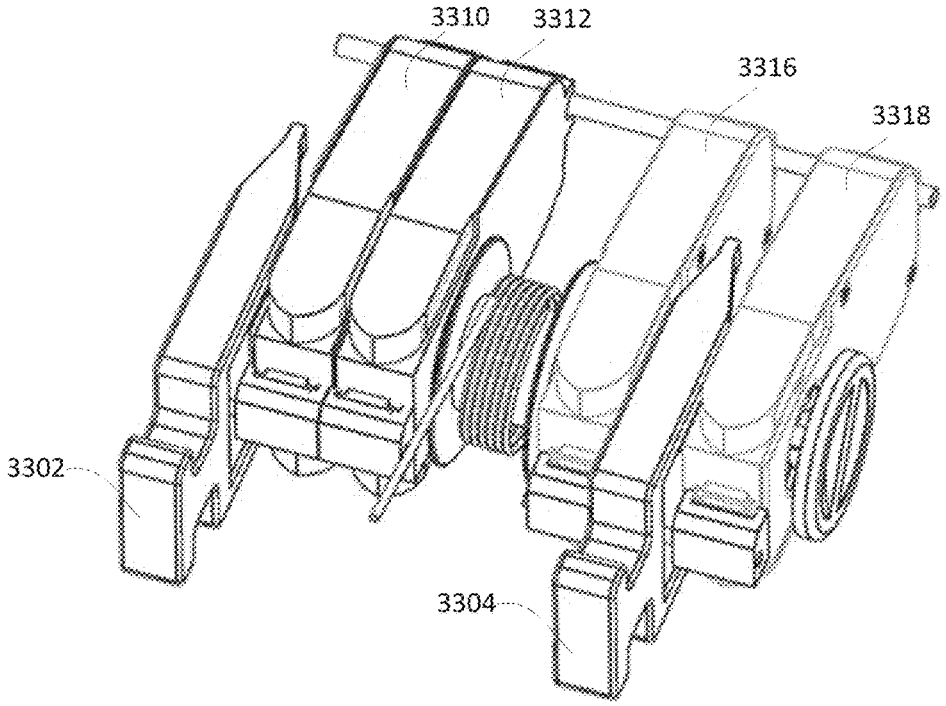
FIG. 33B illustrates another perspective view of the exemplary cable retractor device that includes multiple detachable key pins for setting the resistance level of the device.
Figure 33C:
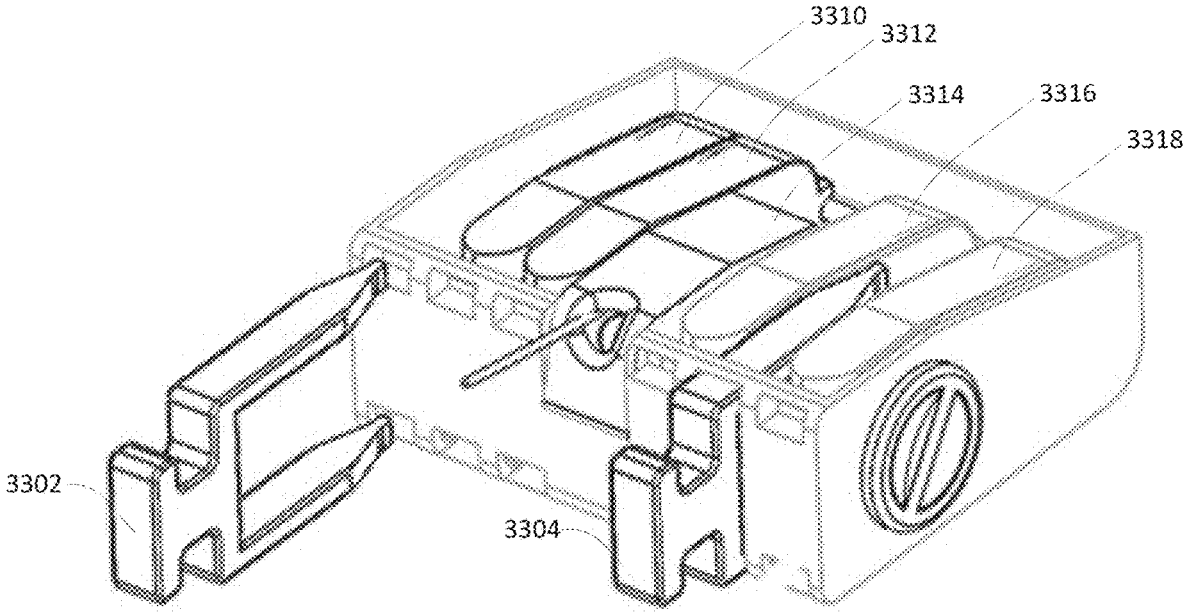
FIG. 33C illustrates another perspective view of the exemplary cable retractor device that includes multiple detachable key pins for setting the resistance level of the device.

FIGS. 33A-D illustrate an exemplary cable retractor device that includes multiple detachable key pins for setting the resistance level of the device. As shown in FIG. 33A, the device 3300 includes a housing 3320, a cord/spool component 3314, and four resistance modules 3310, 3312, 3314, and 3318. The cord/spool component 3314 is disposed in the middle of the housing 3320 between resistance modules 3312 and 3316 and remains stationary relative to the housing 3320. The cord/spool component includes engagement patterns on both sides such that the resistance module 3312 and/or the resistance module 3316 can be pushed into and couple with the cord/spool component. Each of the resistance modules 3312 and 3316 includes engagement patterns on both sides such that either resistance module can be coupled with the cord/spool component and/or the neighboring resistance module (3310 or 3318). Further, each of the resistance modules 3310 and 3318 includes engagement patterns on the side that can contact the neighboring resistance module (3312 or 3316) such that modules 3310 and 3312 may be coupled and modules 3316 and 3318 may be coupled.

Figure 33D:
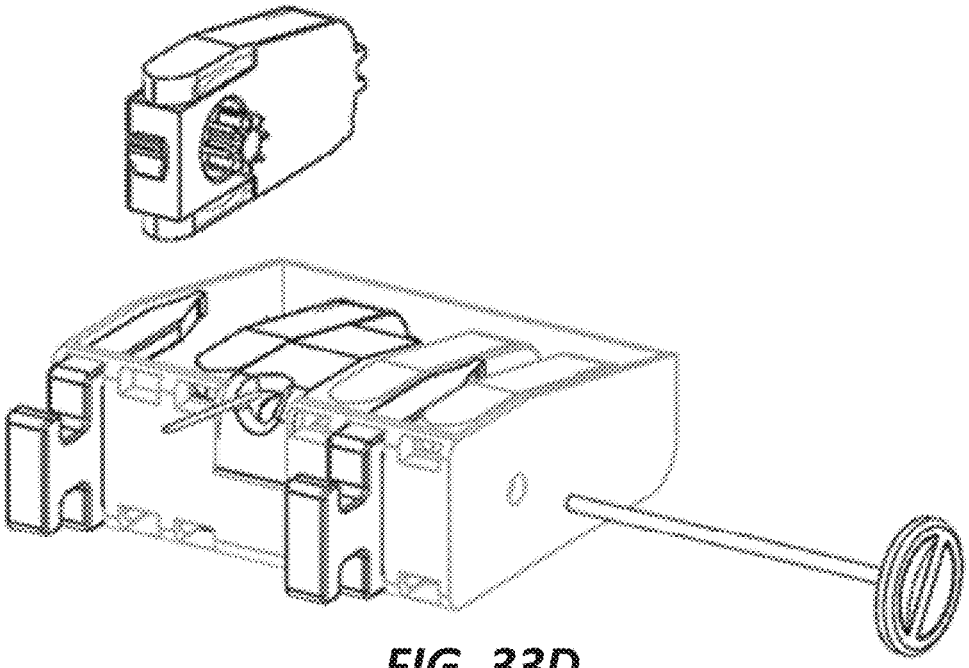
FIG. 33D illustrates another perspective view of the exemplary cable retractor device that includes multiple detachable key pins for setting the resistance level of the device.

The system further includes two detachable key pins 3302 and 3304 for adjusting the resistance level of the device. The two key pins can be inserted between resistance modules, between a resistance module and a lateral surface of the housing, and/or between a resistance module and the cord/spool component. In the depicted example in FIGS. 33A-C, the key pin 3302 is inserted between a lateral wall of the housing and the resistance module 3310. As such, the key pin 3302 pushes the resistance module 3310 and the resistance module 3312 toward the cord/spool component 3314 such that they are coupled together. Further, the key pin 3304 is inserted between the resistance modules 3316 and 3318. As such, the cord/spool component 3314 is coupled with the resistance module 3316, while the resistance modules 3316 and 3318 are not coupled together. Accordingly, in the depicted configuration, the device provides a resistance level that is a combination of resistance modules 3310, 3312, and 3316. One of ordinary skill in the art should appreciate that the device provides five possible resistance levels: zero resistance module, one resistance module, two resistance modules, three resistance modules, and four resistance modules. In some embodiments, at least a portion of the top surface of the device is exposed such that the user can view the interactions between the key pin(s) and the resistance modules. As depicted in FIG. 33D, each resistance module can be removed and replaced, for example, with another resistance module having a different resistance level.

In the depicted embodiment, the key pin 3302 includes two branches such that the key pin does not come in contact with a protruding interlocking gear of a resistance module when the key pin is inserted. Further, each branch has an attenuating distal end such that the key pin can be easily inserted. It should be appreciated that the key pin can include any number of branches and each branch can be of other shapes. For example, the bottom branch of the key pin may include a slot that can engage with a tooth on the housing of the device to secure the key pin in place once it is inserted.

When the cord/spool component is placed on one side of the box, pulling the cable may cause the device to turn sideways and cause the cable to rub against the housing of the device. Positioning the cord/spool component in the middle of the device allows even distribution of the force on the device when the user pulls the cable and minimizes damage to the cable.

In one embodiment, a method, comprising at an apparatus for providing a substantially constant level of resistance, the apparatus having a first resistance module and a second resistance module, providing, when the apparatus is oriented at a first angle from a ground, a first substantially constant resistance level providing, when the apparatus is oriented at a second angle from the ground, the first substantially constant resistance level, wherein the second angle is different from the first angle, coupling the first resistance module with the second resistance module, providing, when the apparatus is oriented at the first angle from the ground, a second substantially constant resistance level, and providing, when the apparatus is oriented at the second angle from the ground, the second substantially constant resistance level.

What is claimed is:

1. An apparatus for providing a substantially constant level of resistance, the apparatus comprising:

a first resistance module configured to provide a substantially constant force resistance at a first resistance level, wherein:

the first resistance module includes a first coupling component, a first drum, and a first constant-force spring having the first resistance level, and a first end of the first constant-force spring is connected to the first drum;

a second resistance module configured to provide a substantially constant force resistance at a second resistance level, wherein:

the second resistance module includes a second drum and a second constant-force spring having the second resistance level, and a first end of the second constant-force spring is connected to the second drum; and wherein:

the second resistance module is directly coupled to the first resistance module via the first coupling component, the coupled first and second resistance modules are configured to provide a substantially constant combined force resistance, and the combined force resistance is the sum of the first resistance level and the second resistance level.

2. The apparatus of claim 1, wherein:

the first resistance module further includes:

a first rear drum, wherein a second end of the first constant-force spring is connected to the first rear drum; and the second resistance module further includes:

a second rear drum, wherein a second end of the second constant-force spring is connected to the second rear drum.

3. The apparatus of claim 2, wherein the first drum and the second drum are configured to rotate in a first direction and the first rear drum and the second rear drum are configured to rotate in a second direction, the first direction opposite of the second direction.

4. The apparatus of claim 1, further comprising a resistance selector set to a first resistance-setting level, wherein the first resistance-setting level corresponds to the sum of the first resistance level and the second resistance level.

5. The apparatus of claim 4, wherein the first resistance module is affixed to the resistance selector.

6. The apparatus of claim 1, further comprising a first compression spring having a first load resistance level, wherein the first compression spring is located between the first and second resistance modules and is compressed by the coupled first and second resistance modules.

7. The apparatus of claim 1, wherein the second resistance module includes a second coupling component, the apparatus further comprising:

a third resistance module configured to provide a substantially constant force resistance at a third resistance level, wherein:

the third resistance module includes a third drum and a third constant-force spring having the third resistance level, a first end of the third constant-force spring is connected to the third drum, and the third resistance module is coupled to the second resistance module via the second coupling component; and wherein the combined force resistance is the sum of the first resistance level, the second resistance level, and the third resistance level.

8. The apparatus of claim 7, further comprising a second compression spring having a second load resistance level, wherein the second compression spring is located between the second and third resistance modules and is compressed by the coupled second and third resistance modules, and wherein the second load resistance is greater than the first load resistance.

9. The apparatus of claim 1, wherein the first coupling component is a gear component, the gear component interlocked to a counterpart gear component on the second resistance module.

10. The apparatus of claim 1, wherein the apparatus further includes a cord spool, and wherein the first drum of the first resistance module is connected to the cord spool.

11. The apparatus of claim 1, further comprising:

a housing that includes a first bracket set and a second bracket set, wherein:

the first resistance module is mounted onto the housing via the first bracket set, and the second resistance module is mounted onto the housing via the second bracket set.

12. The apparatus of claim 11, wherein the housing further includes a third bracket set configured to enable a third resistance module to mount onto the housing.

13. The apparatus of claim 1, the apparatus further comprising a detachable key pin, the detachable key pin configured to couple and decouple the first resistance module and the second resistance module, and wherein the detachable key pin comprises at least one prong.

14. The apparatus of claim 13, wherein the detachable key pin comprises two prongs.

15. A method, comprising:

at an apparatus for providing a substantially constant level of resistance, the apparatus having a first resistance module having a first constant-force spring and a second resistance module having a second constant-force spring:

providing, when the first resistance module is coupled to a second resistance module, a first substantially constant resistance level;

providing a detachable key pin comprising at least one prong, wherein the detachable key pin is configured to decouple the first resistance module from the second resistance module when the detachable key pin is inserted between the first resistance module and the second resistance module;

providing, when the first resistance module is decoupled from the second resistance module, a second substantially constant resistance level, different from the first substantially constant resistance level.

16. The method of claim 15, wherein the apparatus further includes a third resistance module having a third constant-force spring, the method further comprising:

coupling the third resistance module with the second resistance module;

providing, when the third resistance module is coupled with the second resistance module, a third substantially constant resistance level, wherein the detachable key pin is configured to decouple the second resistance module from the third resistance module when the detachable key pin is inserted between the second resistance module and the third resistance module.

17. The method of claim 16, further comprising:

decoupling the third resistance module from the second resistance module by inserting the detachable key pin between the third resistance module and the second resistance module;

providing, when the third resistance module is decoupled from the second resistance module, the second substantially constant resistance level.

18. The method of claim 15, further comprising:

decoupling the second resistance module from the first resistance module by inserting the detachable key pin between the first resistance module and the second resistance module;

providing, when the second resistance module is decoupled from the first resistance module, the first substantially constant resistance level.

19. The method of claim 15, wherein the apparatus further includes a housing that includes a first bracket set, and wherein the first resistance module is mounted onto the housing via the first bracket set, the method further comprising:

detaching the first resistance module from the first bracket set;

removing the first resistance module from the housing;

inserting a fourth resistance module into the housing, wherein:

the fourth resistance module is mounted onto the housing via the first bracket set, and the fourth resistance module has a fourth constant-force spring.

20. The method of claim 15, wherein the detachable key pin comprises two prongs.

* * * * *